US010916219B2

(12) United States Patent
Liu

(10) Patent No.: US 10,916,219 B2
(45) Date of Patent: Feb. 9, 2021

(54) DISPLAY PANEL, DRIVING METHOD AND MANUFACTURING METHOD THEREOF, AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventor: Sha Liu, Beijing (CN)

(73) Assignee: BEIJING BOE DISPLAY TECHNOLOGY CO., LTD. & BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/564,377

(22) Filed: Sep. 9, 2019

(65) Prior Publication Data

US 2020/0320956 A1 Oct. 8, 2020

(30) Foreign Application Priority Data

Apr. 2, 2019 (CN) ..... 2019 1 0262563

(51) Int. Cl.
*G09G 5/00* (2006.01)
*G09G 5/10* (2006.01)

(52) U.S. Cl.
CPC ..... *G09G 5/10* (2013.01); *G09G 2320/0626* (2013.01); *G09G 2330/021* (2013.01); *G09G 2360/144* (2013.01)

(58) Field of Classification Search
CPC .. G09G 5/00; G09G 5/10; G09G 3/36; G09G 2320/0626; G09G 2330/021; G09G 2360/144
See application file for complete search history.

(56) References Cited

U.S. PATENT DOCUMENTS 9,354,735 B2 * 5/2016 Abileah ..... G06F 3/042
2007/0109239 A1 * 5/2007 den Boer ..... G06F 3/042 345/87
2009/0135158 A1 * 5/2009 Takahashi ..... G06F 3/044 345/174
2009/0248344 A1 * 10/2009 Hirabayashi ..... G09G 3/3648 702/85

(Continued)

FOREIGN PATENT DOCUMENTS

CN 101256097 9/2008
CN 101256097 A * 9/2008

(Continued)

OTHER PUBLICATIONS

Chinese Office Action dated Mar. 24, 2020 corresponding to Chinese Patent Application No. 201910262563.0; 28 pages.

*Primary Examiner* — Joe H Cheng
(74) *Attorney, Agent, or Firm* — Leason Ellis LLP

(57) ABSTRACT

A display panel, a driving method and a manufacturing method thereof, and a display device are provided. The display panel includes pixel units arranged in an array. Each pixel unit includes a display pixel part, and at least a part of the pixel units are configured to be composite pixel units; each of the composite pixel units further includes an optical detection part; the optical detection part is configured to execute optical signal acquisition operation; and the display pixel part is configured to execute display operation.

17 Claims, 19 Drawing Sheets

(56) References Cited

U.S. PATENT DOCUMENTS

| | | | | |
|---|---|---|---|---|
| 2010/0134457 | A1* | 6/2010 | Katoh | G09G 3/20 345/207 |
| 2011/0187759 | A1* | 8/2011 | Sasaki | G09G 5/10 345/690 |
| 2011/0242075 | A1* | 10/2011 | Yamamoto | G06F 3/0412 345/207 |
| 2012/0092302 | A1* | 4/2012 | Imai | G06F 3/0412 345/175 |
| 2014/0125631 | A1* | 5/2014 | Lin | G06F 3/0488 345/175 |
| 2016/0253012 | A1* | 9/2016 | Yang | G06F 3/0412 345/175 |
| 2019/0103063 | A1* | 4/2019 | Liu | G02F 1/13318 |

FOREIGN PATENT DOCUMENTS

| | | | | |
|---|---|---|---|---|
| CN | 103019476 | | 4/2013 | |
| CN | 104503622 | | 4/2015 | |
| CN | 106169484 | | 11/2016 | |
| CN | 106169484 | A * | 11/2016 | G09G 3/3225 |
| CN | 106501984 | | 3/2017 | |
| CN | 109031825 | | 12/2018 | |
| CN | 109031825 | A * | 12/2018 | |

* cited by examiner

DISPLAY PANEL, DRIVING METHOD AND MANUFACTURING METHOD THEREOF, AND DISPLAY DEVICE

The application claims priority to the Chinese patent application No. 201910262563.0, filed Apr. 2, 2019, the disclosure of which is incorporated herein by reference as part of the application.

TECHNICAL FIELD

The present disclosure relates to a display panel, a driving method and a manufacturing method thereof, and a display device.

BACKGROUND

With the development of display technology and the wide application of display devices, users have put forward higher requirements for display devices, for example, requiring the display device to adjust the display brightness according to the condition of ambient light, and requiring the display device to have lower power consumption.

At present, the ambient light can be sensed by arranging an ambient light sensor in the display panel, so that the brightness of the display panel can be adjusted and the power consumption can be reduced. However, the above ambient light sensor is usually disposed in a non-display area of the display panel; that is, needing to occupy the area of the effective display area in the display panel. Thus, the proportion of the area of the display area in the entire panel can be reduced, thereby making it difficult to realize the full screen.

SUMMARY

An embodiment of the disclosure provides a display panel, comprising: pixel units arranged in an array, wherein each pixel unit includes a display pixel part, and at least a part of the pixel units are configured to be composite pixel units; each of the composite pixel units further includes an optical detection part; the optical detection part is configured to execute optical signal acquisition operation; and the display pixel part is configured to execute display operation.

In some examples, the display panel further comprises: a control circuit which is respectively connected with the optical detection part and the display pixel part and configured to adjust a display brightness of the display pixel part according to an optical signal detected by the optical detection part.

In some examples, the display pixel part includes a pixel electrode and a pixel transistor; and the optical detection part includes a phototransistor.

In some examples, the pixel transistor and the phototransistor are arranged on a same layer.

In some examples, a gate electrode, an active layer and source/drain electrodes of the pixel transistor are respectively arranged in same layers with a gate electrode, an active layer and source/drain electrodes of the phototransistor.

In some examples, the display panel further comprises: data lines, gate lines and common electrode lines, wherein the optical detection parts in the composite pixel units and the display pixel parts in the display panel share the data lines, the gate lines and the common electrode lines.

In some examples, in each of the composite pixel units, a gate electrode of the pixel transistor and a gate electrode of the phototransistor are connected to a same gate line; a drain electrode of the phototransistor is connected to a corresponding common electrode line; a source electrode of the pixel transistor and a source electrode of the phototransistor are connected to a same data line or different data lines; one of the pixel transistor and the phototransistor is an N-type transistor; and the other one of the pixel transistor and the phototransistor is a P-type transistor.

In some examples, in the composite pixel unit disposed in the $i^{th}$ row and the $j^{th}$ column of the display panel, the gate electrode of the pixel transistor and the gate electrode of the phototransistor are connected to the gate line in the $i^{th}$ row; the drain electrode of the phototransistor is coupled to the corresponding common electrode line; the source electrode of the pixel transistor is connected to the data line in the $j^{th}$ column; and the source electrode of the phototransistor is connected to the data line in the $j^{th}$ column or the $(j+1)^{th}$ column, in which both i and j are a positive integer greater than or equal to 1.

In some examples, the display panel further comprises: data lines, gate lines, common electrode lines and at least one optical acquisition control line, wherein in each of the composite pixel units, a gate electrode of the pixel transistor is connected to a corresponding gate line; a gate electrode of the phototransistor is connected to a corresponding optical acquisition control line; a drain electrode of the phototransistor is connected to a corresponding common electrode line; and a source electrode of the pixel transistor and a source electrode of the phototransistor are connected to a same data line or different data lines.

In some examples, each of the composite pixel units is configured to execute the optical signal acquisition operation according to a signal acquisition instruction sent by the data line connected with the optical detection part, and output the acquired optical signal through the common electrode line.

In some examples, the display panel comprises n rows and m columns of pixel units, in which n is a positive integer greater than or equal to i, and m is a positive integer greater than or equal to j; and positions of the composite pixel units include: in the $i^{th}$ row of pixel units of the display panel, at least a part of pixel units are configured to be the composite pixel units; or in the $j^{th}$ column of pixel units of the display panel, at least a part of pixel units are configured to be the composite pixel units; in the pixel units at a periphery of the display panel, at least a part of pixel units are configured to be the composite pixel units; or the pixel units in the $x^{th}$ row and the $y^{th}$ column of the display panel are configured to be the composite pixel units, in which x is selected from a plurality of positive integers from 1 to n, and y is selected from a plurality of positive integers from 1 to m.

In some examples, a channel length of the phototransistor is greater than a channel length of the pixel transistor.

In some examples, the optical detection part includes a phototransistor of top-gate type, and further comprises a light conversion layer located at a side of a gate electrode of the phototransistor away from an active layer of the phototransistor.

In some examples, the display panel further comprises data lines and common electrode lines, and a source electrode and a drain electrode of the phototransistor are connected to a corresponding data line and a corresponding common electrode line.

An embodiment of the disclosure provides a method for driving a display panel, applied to the display panel as mentioned above, comprising: switching on the display pixel parts in the pixel units to execute the display operation in a first period; and switching on the optical detection parts in the composite pixel units to execute the optical signal acquisition operation in a second period.

In some examples, the display panel includes gate lines and at least one optical acquisition control line; the optical detection parts of the composite pixel units are connected with the at least one optical acquisition control lines; the display pixel parts of the pixel units are connected with the gate lines; and the method comprises: loading a first scanning signal through the gate lines in the first period to switch on the display pixel parts, and loading a second scanning signal through the at least one optical acquisition control line in the second period to switch on the optical detection parts.

In some examples, the display panel includes n rows of pixel units, in which at least a part of pixel units in the $i^{th}$ row of pixel units are configured to be the composite pixel units; i is a positive integer greater than or equal to 1; n is a positive integer greater than or equal to i; and switching on the display pixel parts in the pixel units to execute the display operation and switching on the optical detection parts in the composite pixel units to execute the optical signal acquisition operation includes: sequentially loading a first scanning signal, in the first period of each frame of time through the gate lines from the gate line of the $1^{st}$ row of pixel units to the gate line of the $n^{th}$ row of pixel units, to sequentially switch on each row of display pixel parts to execute the display operation, and loading a second scanning signal, in the second period of each frame of time through the gate line of the $i^{th}$ row of pixel units, to switch on the optical detection parts of the composite pixel units in the $i^{th}$ row of pixel units to execute the optical signal acquisition operation.

In some examples, the display panel includes n rows of pixel units, in which in each row of pixel units in at least two rows of pixel units, at least a part of pixel units are configured to be the composite pixel units; n is a positive integer greater than or equal to 2; and switching on the display pixel parts in the pixel units to execute the display operation and switching on the optical detection parts in the composite pixel units to execute the signal acquisition operation includes: sequentially loading a first scanning signal, in the first period of each frame of time through the gate lines from the gate line of the $1^{st}$ row of pixel units to the gate line of the $n^{th}$ row of pixel units, to sequentially switch on each row of display pixel parts to execute the display operation; sequentially loading a second scanning signal, in the second period of each frame of time through the gate lines from the gate line of the $x^{th}$ row of pixel units to the gate line of the $y^{th}$ row of pixel units, to switch on the optical detection parts of the composite pixel units in each row of pixel units from the $x^{th}$ row of pixel units to the $y^{th}$ row of pixel units to execute the optical signal acquisition operation, in which the $x^{th}$ row of pixel units to the $y^{th}$ row of pixel units are the at least two rows of pixel units provided with the composite pixel units; x is a positive integer greater than or equal to 1 and less than or equal to y; y is a positive integer greater than x and less than or equal to n; numbers from x to y are serial numbers or non-continuous numbers; or in the scanning time of scanning the $z^{th}$ row of pixel units of each frame of time, loading a first scanning signal, in the first period through the gate line of the $z^{th}$ row of pixel units, to switch on the $z^{th}$ row of display pixel parts to execute the display operation, and loading a second scanning signal, in the second period through the gate line of the $z^{th}$ row of pixel units, to switch on the optical detection parts of the composite pixel units in the $z^{th}$ row of pixel units to execute the optical signal acquisition operation, in which the $z^{th}$ row of pixel units is one of the at least two rows of pixel units provided with the composite pixel units; and z is a positive integer greater than or equal to 1 and less than or equal to n.

An embodiment of the disclosure provides a display device, comprising: the display panel according to claim 1 and an optical sensing module connected with the optical detection part in each of the composite pixel units of the display panel, wherein the optical sensing module is configured to receive an optical signal acquired by the optical detection part and generate an adjustment value for adjusting a brightness of the pixel unit in the display panel according to the optical signal.

In some examples, the display device further comprises: a display control module connected with the optical sensing module and configured to receive the adjustment value generated by the optical sensing module and adjust the brightness of the pixel unit in the display panel according to the adjustment value.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

The ambient light sensor in the display device can sense the ambient light, and a processing chip can automatically adjust the brightness of the display panel based on the sensed ambient light condition, thereby reducing the power consumption of the display device. For example, in mobile electronic products such as mobile phones, notebook computers and tablet PCs, the display panel consumes up to 30% of the total battery power, and the ambient light sensor can maximize the operating time of the battery. In addition, the ambient light sensor helps the display panel to provide a soft image: when the ambient brightness is high, the display panel employing the ambient light sensor will automatically adjust the brightness to be high; and when the external environment is dark, the display panel will automatically adjust the brightness to be low.

Figure 1:
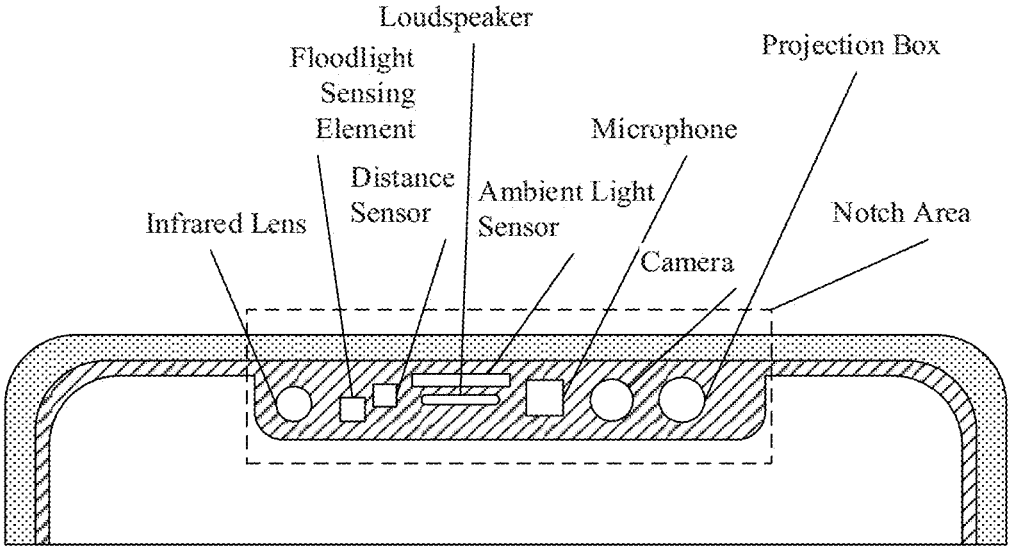
FIG. 1 is a schematic structural view of a display panel.

FIG. 1 is a schematic structural view of a display panel. FIG. 1 only shows partial portion on the upper side of the display panel. As can be seen from FIG. 1, the "notch area (i.e., the concave portion at the edge of the display area)" of the display panel is provided with important components such as a camera and an ambient light sensor, and the "notch area" is actually a non-display area of the display panel. Obviously, the ambient light sensor occupies the area of the effective display area in the display panel, and reduces the proportion of the display area, thereby making it difficult to realize the full screen. In addition, as low power consumption is taken as the core requirement of mobile electronic products, the ambient light sensor has become one of the indispensable devices for mobile electronic products. The ambient light sensor not only automatically adjusts the brightness according to the ambient light, but also adjusts the color temperature to make the eyes feel more comfortable.

Due to the presence of functional devices (such as the camera and the ambient light sensor) in the display panel, true full screen cannot be fully realized. Pop-up cameras, rotating cameras, slide-type cameras and the like have emerged currently to remove the camera from the front of the display screen. However, there is currently no effective design solution for transferring the ambient light sensor from the display area of the display panel to realize the requirement of increasing the ratio of the display area.

The following embodiments provided by the present disclosure can be combined with each other, and the same or similar concepts or processes may not be further described in some embodiments.

FIG. 2 is a schematic structural view of a display panel provided by the embodiment of the present disclosure. A display panel 100 provided by the embodiment comprises: pixel units 110 arranged in an array, in which at least a part of pixel units 110 are configured to be composite pixel units 110*a*, and each of the composite pixel units 110*a* includes an optical detection module 111 and a pixel structure for displaying (not shown in FIG. 2). The pixel units other than the composite pixel unit also include pixel structure for displaying. For instance, the optical detection module 111 may be taken as the optical detection part of the composite pixel unit, and the pixel structure for displaying may be taken as the display pixel part. As shown in FIG. 2, taking the case that the display panel 100 comprises red, green and blue (RGB for short) pixel units 110 arranged in array as an example, at least a part of the pixel units 110 in the embodiment of the present disclosure are configured to be the composite pixel units 110*a*, that is, the composite pixel units 110*a* are pixel units 110 with specific structure and function in the display panel 100. FIG. 2 only shows the overall structure of the display panel 100 (but not showing specific structure therein). For instance, FIG. 2 shows the pixel units 110 arranged in an array and at least a part of the pixel units 110 which are configured to be the composite pixel units 110*a*. FIG. 2 illustratively shows the optical detection module 111 integrated into the composite pixel unit 110*a* and does not show the specific structure in the composite pixel unit 110*a* (for instance, not showing the pixel structure). Moreover, it is shown in FIG. 2 by taking the case that the $1^{st}$ row of pixel units 110 are integrally configured to be the composite pixel units 110*a* as an example. It should be noted that which pixel units 110 are configured to be the composite pixel units 110*a* provided with the optical detection modules 111 is not limited in the embodiment of the present disclosure, for instance, a part or all of the pixel units 110 may be configured to be the composite pixel units 110*a*.

For example, the pixel structure or the display pixel part can be a liquid crystal display (LCD) pixel structure or an organic light emitting diode (OLED) pixel structure, but the embodiments of the disclosure are not limited thereto.

In the display panel 100 provided by the embodiment of the present disclosure, the composite pixel unit 110*a* is configured to switch on the pixel structure to execute display operation in the first period and switch on the optical detection module 111 to execute optical signal acquisition operation in the second period.

The display panel 100 provided by the embodiment of the present disclosure has the function of automatically adjusting the display brightness according to the brightness of ambient light. Therefore, a functional module for detecting the brightness of the ambient light is integrated into the display panel 100, but the functional module is not the ambient light sensor disposed in the non-display area (for instance, the "notch area" in FIG. 1) of the display panel, but the functional module is integrated into at least a part of the pixel units 110 (namely the composite pixel units 110*a*) of the display panel.

For instance, the display panel further comprises a control circuit which is respectively connected with the optical detection modules 111 and the pixel structures and configured to adjust the display brightness of the pixel structures according to optical signals detected by the optical detection modules 111. For example, the control circuit may have a function at least overlapping with that of the optical sensing module and the display control module and the like. In this case, the function of the control circuit can also be realized by the optical sensing module, the display control module and the like.

In the embodiment of the present disclosure, as the composite pixel unit 110*a* has the structure characteristics of the conventional pixel unit 110 (namely the composite pixel unit 110*a* includes the pixel structure) and the optical detection module 111 is integrated on the basis of the structure of the conventional pixel unit 110, the functions realized by the structures or the modules in the composite pixel unit 110*a* include: the pixel structure is configured to execute the display operation, and the optical detection module 111 is configured to execute the optical signal acquisition operation, that is, an operation of detecting the brightness of the ambient light. In addition, as the pixel structure and the optical detection module 111 are integrated into one composite pixel unit 110*a*, the composite pixel unit 110*a* can only execute one of the above operations through a data line at the same period. Thus, the mode of the composite pixel unit 110*a* in executing the operation may be set to switch on the pixel structure to execute the display operation in the first period and switch on the optical detection module 111 to execute the optical signal acquisition operation in the second period.

The functional module for detecting the brightness of the ambient light (namely the optical detection module 111) in the display panel 100 provided by the embodiment is integrated into internal structures of some pixel units 100, and these pixel units 110 integrated with the optical detection modules 111 are the composite pixel units 110*a*. The optical detection module 111, for instance, is a transistor having photosensitivity. As the pixel structure for controlling the switching of the pixel unit 110 in the display panel generally includes a pixel transistor (for instance, a transistor for controlling or driving the pixel structure to display), for instance, including a thin-film transistor (TFT). Based on the characteristic that the structures of the phototransistor and the pixel transistor are similar, the optical detection module 111 may be manufactured at the same time when the pixel transistor of the display panel 100 is manufactured, and the optical detection module 111 can be manufactured by only opening up a small area space in the composite pixel unit 110*a*. Therefore, due to the arrangement mode of the optical detection module 111 for detecting the brightness of the ambient light in the embodiment of the present disclosure, the optical detection module 111 can be simultaneously manufactured in the conventional manufacturing process of the display panel 100, and the optical detection module 111 is integrated into a display area of the display panel 100, so the manufactured optical detection module 111 not only can realize the function of detecting the brightness of the ambient light but also will not occupy the area of the effective display area in the display panel 100, that is, the optical detection module 111 is completely invisible as for the display panel 100.

Based on the arrangement mode and the position of the optical detection module 111 in the display panel 100 provided by the embodiment of the present disclosure and the process of manufacturing the optical detection module 111, on one hand, the influence of the arrangement of the ambient light sensor in the non-display area of the display pane on the effective display area can be avoided; the integration of more elements in the display panel can be realized; the proportion of the display area can be improved; and then true full screen can be realized. On the other hand, the assembly process required by arranging the ambient light sensor on the outside of the display panel can be reduced, so the process flow can be simplified. In addition, due to the optimum of the process and the design, the production cost of the display panel can be reduced, thereby realizing the integration of the industry chain and improving the added value of the display panel.

The display panel 100 provided by the embodiment of the present disclosure comprises pixel units 110 arranged in an array, in which at least a part of pixel units 110 are configured to be composite pixel units 110*a*; the composite pixel unit 110*a* includes an optical detection module 111 and a pixel structure; the optical detection module 111 is configured to execute optical signal acquisition operation; and the pixel structure is configured to execute display operation. In addition, the composite pixel unit 110*a* can switch on the pixel structure to execute the display operation in the first period, and switch on the optical detection module 111 to execute the optical signal acquisition operation in the second period. In the display panel 100 provided by the embodiment of the present disclosure, by adoption of the arrangement mode of integrating the optical detection module 111 for detecting the brightness of the ambient light into the composite pixel unit 110*a*, the optical detection module 111 can be simultaneously manufactured in the conventional manufacturing process of the display panel 100, so as to integrate the optical detection module 111 into the display panel 100. The manufactured optical detection module 111 not only can realize the function of detecting the brightness of the ambient light but also will not occupy the effective display area in the display panel. On one hand, the proportion of the display area in the display panel can be improved, and then true full screen can be realized. On the other hand, as the optical detection module 111 may be formed at the same time with the pixel structure, the manufacturing process is simple; the production cost of the display panel can be reduced; and the integration of the industry chain can be realized.

Figure 3A:
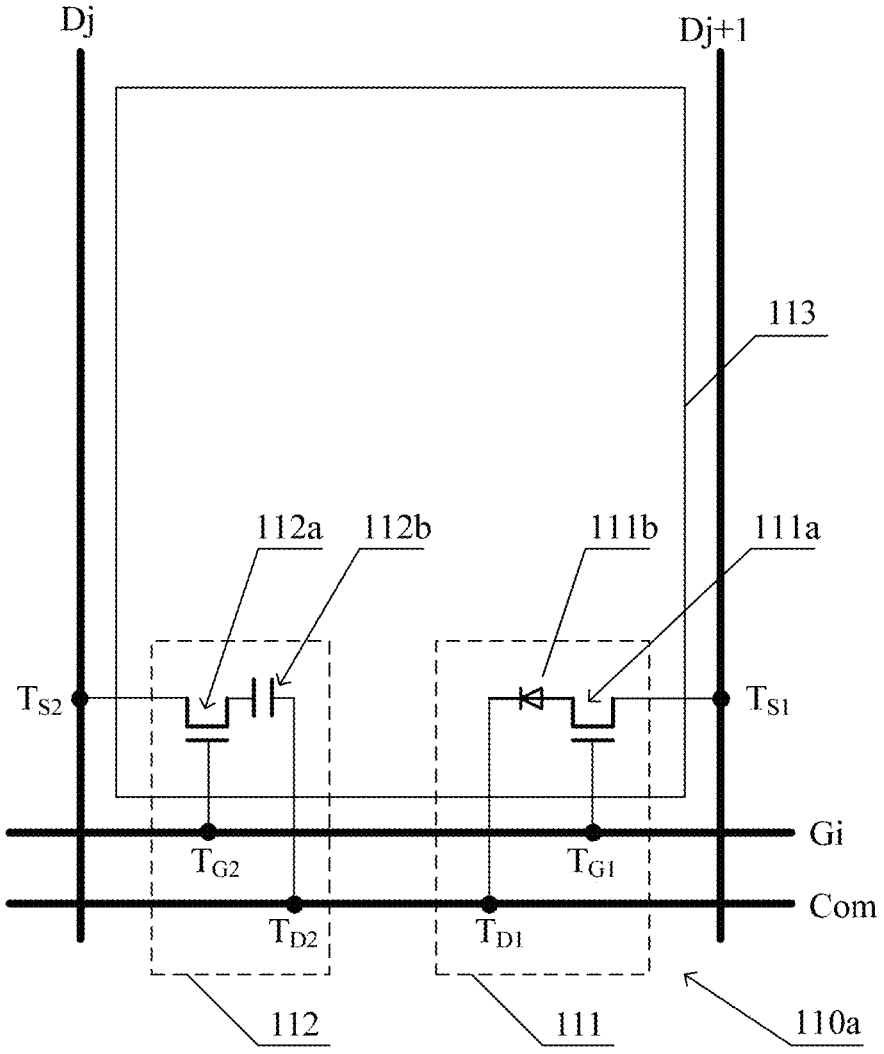
FIG. 3A is a schematic structural view of a composite pixel unit in the display panel provided by an embodiment of the present disclosure.

For instance, FIG. 3A is a schematic structural view of a composite pixel unit in the display panel provided by the embodiment of the present disclosure. In the embodiment of the present disclosure, the display panel 100 may generally comprise: data lines, gate lines G and a common electrode line Com. FIG. 3A only shows the structure of one composite pixel unit 110*a* in the display panel 100.

In the embodiment of the present disclosure, the optical detection module 111 in the composite pixel unit 110*a* and the pixel structure in the display panel share the data line D, the gate line G and the common electrode line Com. Generally, in the display panel 100, all the pixel structures share one common electrode line Com; the optical detection modules 111 also share the common electrode line Com; all the pixel structures and the optical detection modules disposed in one row share the gate line in this row; and the pixel units 110 disposed in one column share one data line. The optical detection modules 111 can share the data line in the column provided with the composite pixel unit 110*a* or an adjacent column thereof.

In the embodiment of the present disclosure, the pixel structure may include: a pixel electrode 113 and a pixel transistor 112. The pixel transistor 112 may include a TFT

112*a*, and the optical detection module 111 includes a photosensitive TFT 111*a*. For instance, other elements may also be disposed in the pixel structure and the optical detection module 111. For instance, as shown in FIG. 3A, the pixel structure further includes a capacitor 112*b* connected between a drain electrode $T_{D2}$ and the common electrode line Com, and the optical detection module 111 further includes a diode 111*b* of which a positive pole is connected to a drain electrode $T_{D1}$ and a negative pole is connected to a common electrode line Com. In the composite pixel unit 110*a* of the embodiment of the present disclosure, gate electrodes of the pixel TFT 112*a* and the photosensitive TFT 111*a* are connected to the same gate line; the drain electrode of the photosensitive transistor 111*a* is connected to the common electrode line Com; and source electrodes of the transistors 112*a* and 111*a* are connected to the same data line or different data lines. Although not shown specifically, the drain electrode of the pixel TFT 112*a* can be connected to the pixel electrode 113.

For instance, in the embodiment of the present disclosure, the pixel transistor and the phototransistor may be transistors of different types. For instance, one is an N-type transistor and the other one is a P-type transistor. In this case, when the pixel transistor and the phototransistor are connected to the same gate line, the two transistors are switched on at different periods with different on-signals or scanning signals and will not affect each other.

In one example of the embodiment of the present disclosure, a data line Dj of the $j^{th}$ column of pixel units 110, a gate line Gi of the $i^{th}$ row (namely the pixel units 110), the common electrode line Com, and the $i^{th}$ row and the $j^{th}$ column of pixel units 110 are shown in the structure of the display panel 100 as shown in FIG. 3A, and the $i^{th}$ row and the $j^{th}$ column of pixel units 110 are configured to be the composite pixel units 110*a*, in which both i and j are a positive integer greater than or equal to 1. It can be seen that in the composite pixel unit 110*a*, both a gate electrode $T_{G2}$ of the pixel TFT 112*a* and a gate electrode $T_{G1}$ of the photosensitive TFT 111*a* are connected to the same gate line Gi, and the drain electrode $T_{D1}$ of the photosensitive TFT 111*a* is connected to the common electrode line Com. The drain electrode $T_{D2}$ of the pixel TFT 112*a* is connected with a pixel electrode 113, and an equivalent capacitor (namely a capacitor 112*b*) can be formed by the voltage difference between the common electrode line Com and the pixel electrode 113. The grayscale of the composite pixel unit 110*a* in the process of executing the display operation can be controlled by control of the voltage difference. It is shown in FIG. 3A by taking the case that a source electrode $T_{S2}$ of the pixel TFT 112*a* is connected to the data line Dj and a source electrode $T_{S1}$ of the photosensitive TFT 111*a* is connected to the data line Dj+1 as an example. For instance, the source electrode $T_{S1}$ of the photosensitive TFT 111 may also be connected to the data line Dj.

For instance, in the embodiment of the present disclosure, the implementation in which the composite pixel unit 110*a* switches on the optical detection module 111 to execute the optical signal acquisition operation may include: the composite pixel unit 110*a* is configured to execute the optical signal acquisition operation according to a signal acquisition instruction sent by the data line connected with the optical detection module 111, and output the acquired optical signal through the common electrode line.

As shown by the connection mode of the pixel TFT 112*a* and the photosensitive TFT 111*a* in the composite pixel unit 110*a* as shown in FIG. 3A, when the normal display function is enabled, the pixel transistor 112 is normally switched on; when the optical detection module 111 is switched on to execute the acquisition operation, the data line connected with the optical detection module (for instance, the data line Dj+1 in FIG. 3A) is taken as a signal input terminal, and the common electrode line Com is taken as a signal output terminal; the signal acquisition instruction is transmitted to the optical detection module 111 through the data line to indicate the optical detection module 111 to execute the optical signal acquisition operation; a signal about light intensity (for instance, the light intensity of the ambient light) acquired by the optical detection module 111 is transmitted to a chip for processing the signal of the display device comprising the display panel 100 and a timing controller (T-Con) through the common electrode line Com; and finally, a complete display image is formed.

Figure 3B:
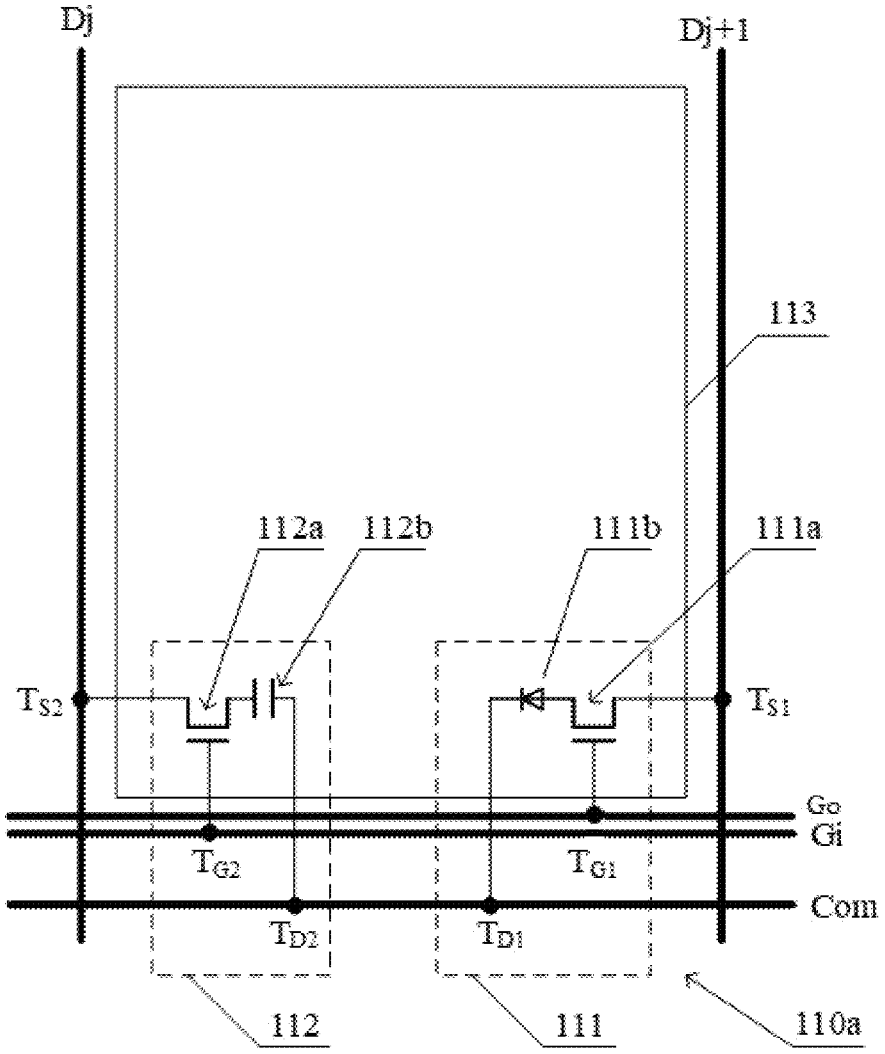
FIG. 3B is a schematic structural view of a composite pixel unit in the display panel provided by an embodiment of the present disclosure.

The embodiment of the present disclosure further provides a display panel, as shown in FIG. 3B. The difference between FIG. 3B and FIG. 3A is only that the optical detection module 111 is independently provided with an optical acquisition control line Go. As shown in FIG. 3B, the gate electrode of the phototransistor of the optical detection module 111 is connected to the optical acquisition control line Go. Thus, the optical detection module 111 can be independently controlled. In the case of time-sharing display and optical signal acquisition, the gate line is kept to be not loaded with the on signal when the optical detection module is switched on through the optical acquisition control line, so as to better display the effect between the signal and the acquired optical signal. Other aspects of FIG. 3B are the same with those in FIG. 3A. Therefore, except that the optical acquisition control line is adopted to control the switching of the optical detection module, various driving methods or control methods relevant to FIG. 3A can all be applied to the structure in FIG. 3B, and no further description will be given here. For instance, in the case as shown in FIG. 3B, a first scanning signal is loaded in the first period through the gate lines to switch on the pixel structures to display, and a second scanning signal (signal for turning on the phototransistor) is loaded in the second period through the optical acquisition control lines to switch on the optical detection modules for detection.

The connection mode of the optical detection module and the gate line, the common electrode line and the data line in the embodiment of the present disclosure is not limited to the example as described above. For instance, on the basis of the structure in FIG. 3A, the gate electrode of the phototransistor of the optical detection module can be connected to the gate line corresponding to another row of pixels. Or an optical signal transmission line is additionally arranged on the basis of FIG. 3B, and the source electrode of the phototransistor of the optical detection module is connected to the optical signal transmission line. Or on the basis of the structure in FIG. 3A, the gate electrode of the phototransistor of the optical detection module is also connected to the common electrode line. Thus, both the gate electrode and the drain electrode of the phototransistor are connected to the common electrode line to form a photodiode.

The embodiment as shown in FIG. 2 only shows one implementation of arranging the composite pixel units 110*a* in the display panel 100. The embodiment of the present disclosure is not limited to the case that the composite pixel units 110*a* are only arranged by the mode as shown in FIG. 2. Description will be given below to some implementations of arranging the composite pixel units 110*a* with reference to specific examples, in which the display panel 100 is set to comprise n rows and m columns of pixel units 110, that is, the array form of the pixel units 110 is n*m, namely the display panel 100 has n pixel rows and m pixel columns, in which n is a positive integer greater than or equal to i, and m is a positive integer greater than or equal to j.

In some examples, in the $i^{th}$ row of pixel units 110 of the display panel 100, at least a part of pixel units 110 are configured to be composite pixel units 110*a*, in which i is a positive integer greater than or equal to 1 and less than or equal to n. In this configuration mode, the pixel row provided with the composite pixel units 110*a* may be any row from the $1^{st}$ row to the $n^{th}$ row. In the pixel row provided with the composite pixel units 110*a*, all or a part of the pixel units 110 may be configured to be the composite pixel units 110*a*. As shown by the structure in FIG. 2A or FIG. 2B, the $1^{st}$ row of pixel units 110 are all configured to be the composite pixel units 110*a*.

Figure 4:
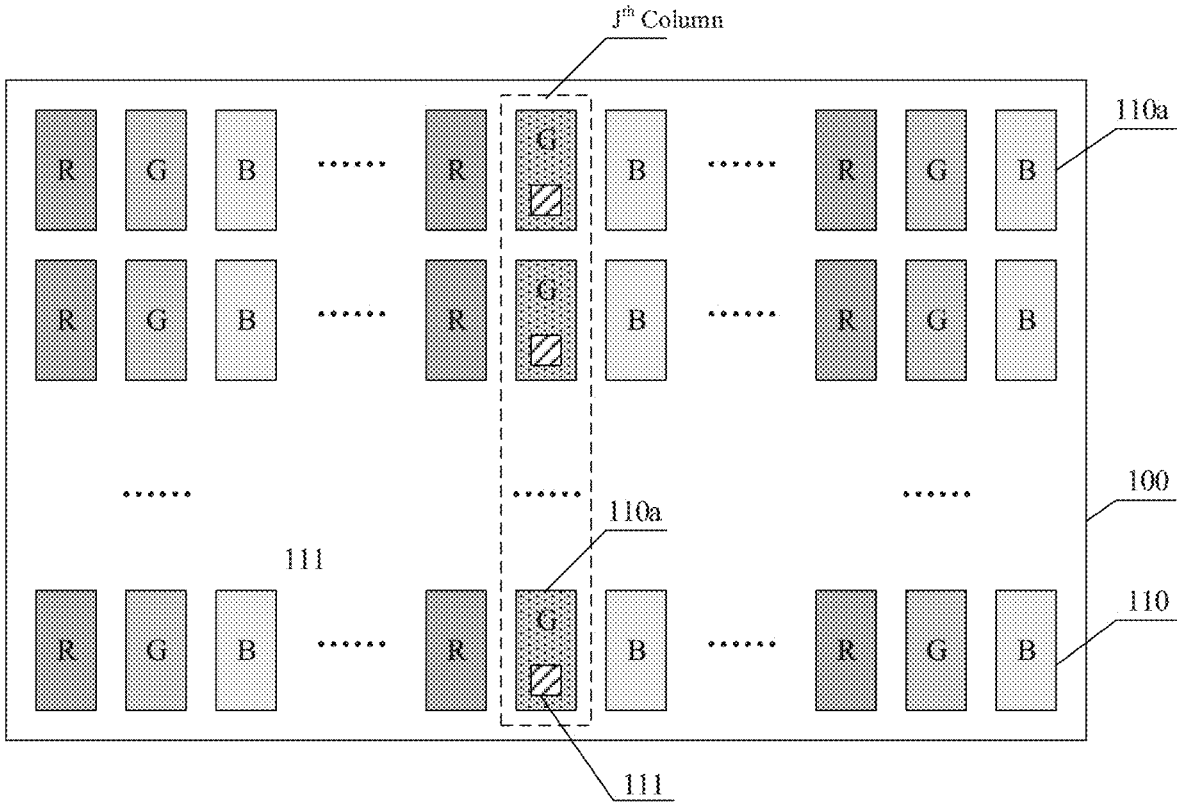
FIG. 4 is a schematic structural view of another display panel provided by an embodiment of the present disclosure.

In some examples, in the $j^{th}$ column of pixel units 110 of the display panel 100, at least a part of the pixel units 110 are configured to be composite pixel units 110*a*, in which j is a positive integer greater than or equal to 1 and less than or equal to m. In this configuration mode, the pixel column provided with the composite pixel units 110*a* may be any column from the $1^{st}$ column to the $m^{th}$ column. In the pixel column provided with the composite pixel units 110*a*, all or a part of the pixel units 110 may be configured to be the composite pixel units 110*a*. FIG. 4 is a schematic structural view of another display panel provided by the embodiment of the present disclosure. It is shown in FIG. 4 by taking the case that all the pixel units 110 in the $j^{th}$ column are configured to be the composite pixel units 110*a* as an example.

Figure 5:
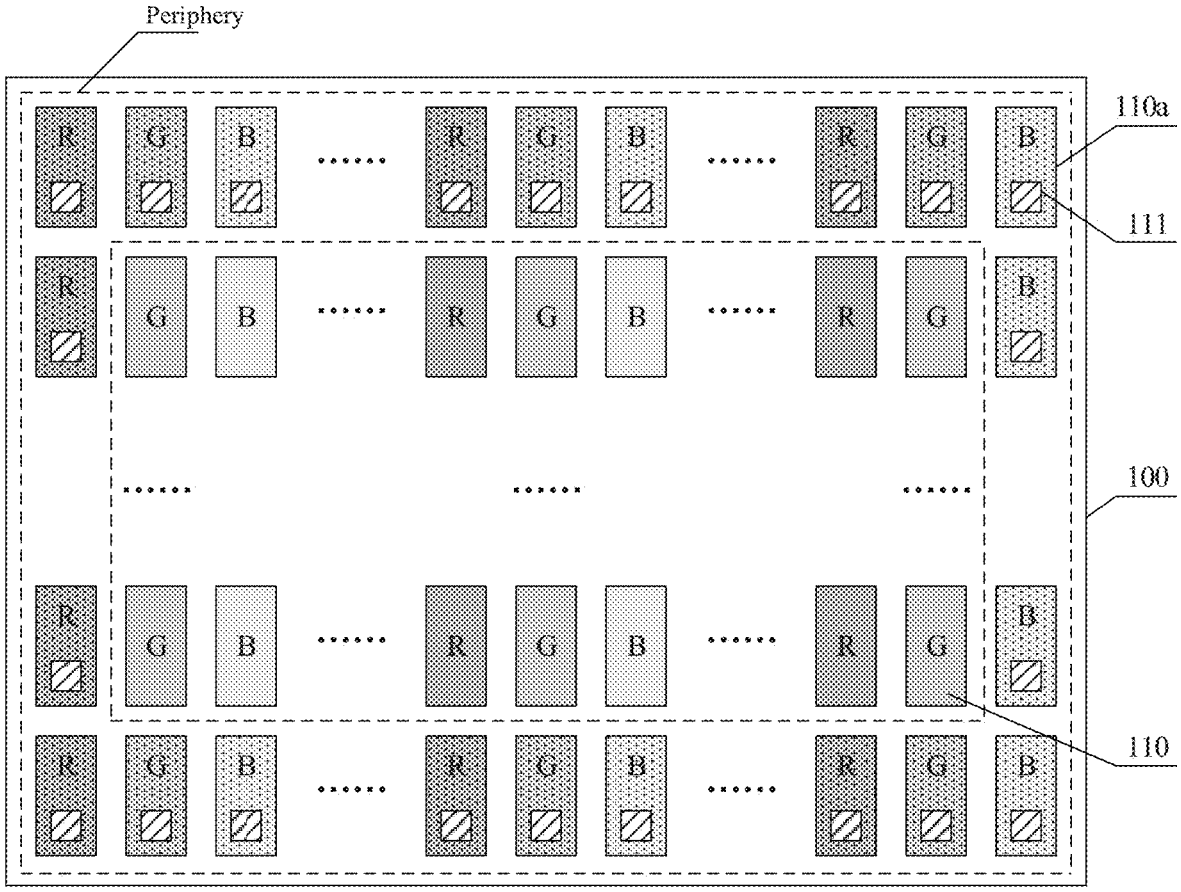
FIG. 5 is a schematic structural view of still another display panel provided by an embodiment of the present disclosure.

In some examples, in the pixel units 110 on the periphery of the display panel 100, at least a part of the pixel units 110 are configured to be composite pixel units 110*a*. In this configuration mode, a circle of pixel units 110 at the outmost periphery of the display panel 100 may be selected to be the composite pixel units 110*a*. For instance, all the pixel units 110 at the periphery are configured to be the composite pixel units 110*a*. FIG. 5 is a schematic structural view of still another display panel provided by the embodiment of the present disclosure. It is shown in FIG. 5 by taking the case that a circle of pixel units 110 at the outmost periphery of the display panel 100 are configured to be the composite pixel units 110*a* as an example.

Figure 6:
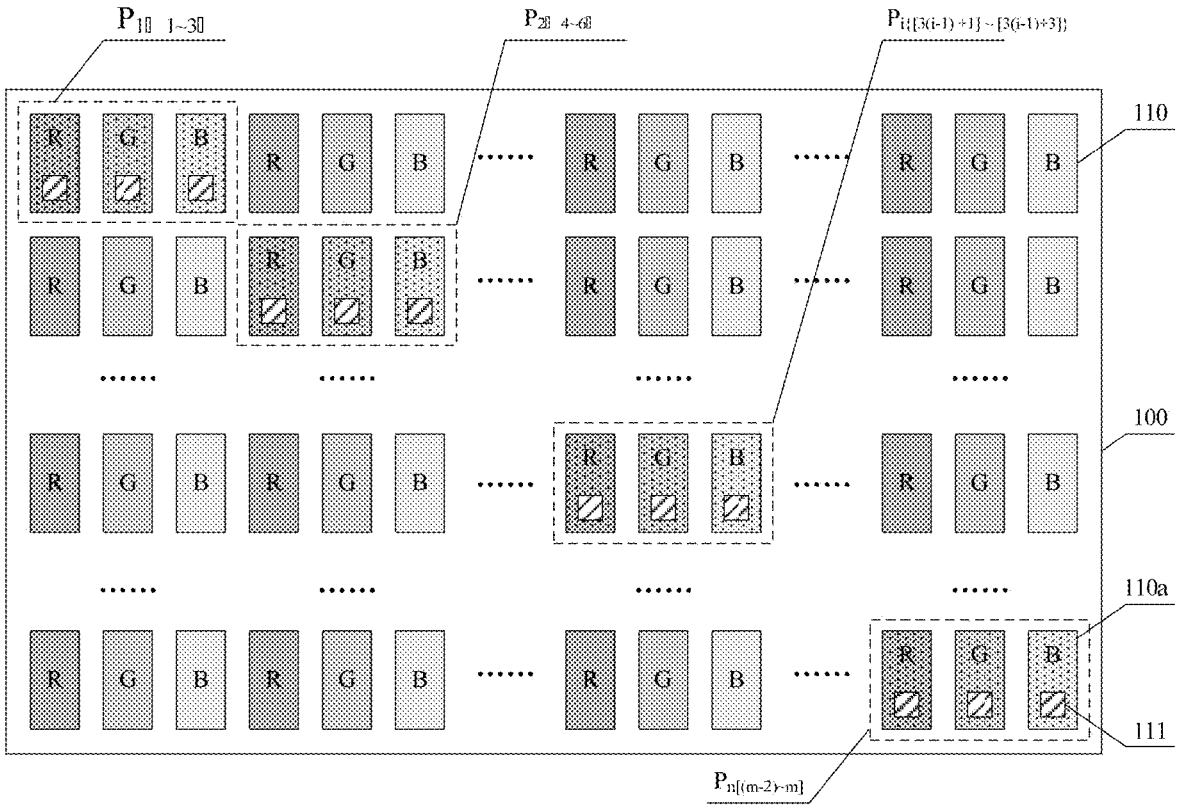
FIG. 6 is a schematic structural view of still another display panel provided by an embodiment of the present disclosure.

In some examples, the $x^{th}$ row and the $y^{th}$ column of pixel units 110 in the display panel 100 are configured to be composite pixel units 110*a*, in which x is selected from a plurality of positive integers from 1 to n, and y is selected from a plurality of positive integers from 1 to m. In this configuration mode, a plurality of pixel units 100 in the display panel 100 may be discretely selected as the composite pixel units 110*a*. FIG. 6 is a schematic structural view of still another display panel provided by the embodiment of the present disclosure. It is shown in FIG. 6 by taking the case that the pixel units 100 in the $1^{st}$ row and the $1^{st}$ column to the $3^{rd}$ column (expressed as $P_{1(1\sim3)}$), the pixel units 100 in the $2^{nd}$ row and the $4^{th}$ column to the $6^{th}$ column (expressed as $P_{2(4\sim6)}$), the pixel units 100 in the $i^{th}$ row and $(3(i-1)+1)^{th}$ column to $(3(i-1)+3)^{th}$ column (expressed as $P_{i\{[3(i-1)+1]\sim[3(i-1)+3]\}}$) . . . the pixel units 100 in the $n^{th}$ row and the $(m-2)^{th}$ column to the $m^{th}$ column (expressed as $P_{n[(m-2)\sim m]}$) are configured to be the composite pixel units 110*a* as an example.

It should be noted that in the embodiment of the present disclosure, the configuration mode and the position of the composite pixel units 110*a* are not limited to several cases as described above. For instance, the number and the specific position of the composite pixel unit 110*a* may be set according to the scanning modes of the display panel 100 (for instance, line scan, column scan or other scanning modes), the size of the display panel 100, and the requirement on the sensitivity of the ambient light.

Figure 7:
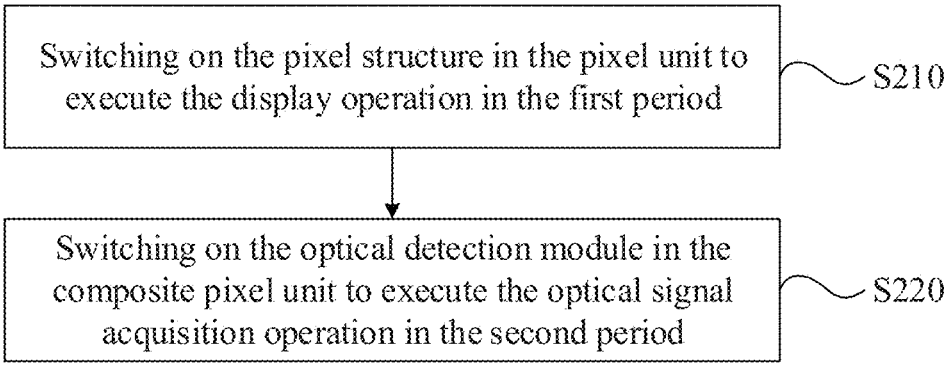
FIG. 7 is a flowchart of a method for driving a display panel, provided by an embodiment of the present disclosure.

Based on the display panel 100 provided by the above embodiment of the present disclosure, the embodiment of the present disclosure further provides a method for driving the display panel. The method for driving the display panel is executed by the display panel provided by any foregoing embodiment of the present disclosure. FIG. 7 is a flowchart of the method for driving the display panel, provided by the embodiment of the present disclosure. The driving method comprises the following steps:

S210: switching on the pixel structures in the pixel units to execute the display operation in the first period; and S220: switching on the optical detection modules in the composite pixel units to execute the optical signal acquisition operation in the second period.

The driving method provided by the embodiment of the present disclosure is executed by the display panel 100 provided by any embodiment as shown in FIGS. 2A to 6. The structural characteristics of the display panel 100, the mode of arranging the composite pixel units in the display panel, and the functions realized by the pixel units, the composite pixel units and the optical detection modules have been described in detail in the above embodiments, so no further description will be given here. Based on the structural characteristics of the display panel 100 provided by the above embodiment of the present disclosure, the method for driving the display panel not only comprises the driving mode of switching on the pixel structure in the pixel unit by scanning to realize display in the conventional display panel, but also comprises the additional driving mode of the composite pixel units integrated with the optical detection modules.

In the embodiment of the present disclosure, the composite pixel units also belong to the pixel units and are special pixel units with special function (namely capable of detecting the brightness of the ambient light), and have all the structural characteristics of the conventional pixel units (namely the composite pixel units includes the pixel structures). In the process of switching on the pixel structures in the pixel units to execute the display operation in the first period, the composite pixel units are taken as displaying units in the entire pixel array, and executes the same operation with the conventional pixel units. That is to say, in the process of executing the display operation in S210, the composite pixel units are regarded as the conventional pixel units and scanned by the preset scanning mode, so that the display panel can realize display function. It should be noted that the scanning mode in the process of executing the display operation of the display panel is not limited in the embodiment of the present disclosure, for instance, may be line scan, column scan or other scanning modes.

As the display panel for executing the driving method provided by the embodiment of the present disclosure is provided with the composite pixel units, based on the structural and functional characteristic that these composite pixel units are integrated with the optical detection modules, apart from the process that the display panel executes the display operation, a period (namely a second period) may be specially opened up, and the optical detection module is switched on at this period to execute the optical signal acquisition operation, and the acquired optical signal may be taken as data information for subsequently adjusting the brightness and the color temperature of the display panel. For instance, the mode of executing the optical signal acquisition operation by switching may be similar to the mode of executing the display operation by scanning. For instance, the rows or the columns provided with the composite pixel units are sequentially switched on according to the preset scanning mode such as line scan or column scan.

It should be noted that the mode of setting the first period and the second period is not limited in the embodiment of the present disclosure. For instance, in each frame of scanning time, the first 80% of the time may be taken as the display period (namely the first period) to execute the display operation of all the rows, and the last 20% of time may be taken as the acquisition period (namely the second period) to execute the acquisition operation; and the first period for display and the second period for signal acquisition may also be set by other means.

In the method for driving the display panel provided by the embodiment of the present disclosure, the display panel provided by any foregoing embodiment as shown in FIGS. 2A-6 is adopted to execute the driving method. The driving method may comprise: switching on the pixel structures in the pixel units to execute the display operation in the first period, and switching on the optical detection modules in the composite pixel units to execute the optical signal acquisition operation in the second period. In the method for driving the display panel provided by the embodiment of the present disclosure, based on the structural characteristic that the optical detection module for detecting the brightness of the ambient light is integrated into the composite pixel unit, all the pixel units (including the composite pixel units) can be controlled to execute the display operation at the display period (namely the first period); the composite pixel units can be controlled to execute the acquisition operation at the acquisition period (namely the second period); and the acquired optical signal can be taken as data information for subsequently adjusting the brightness and the color temperature of the display panel. The driving method provided by the embodiment of the present disclosure can effectively realize the automatic adjustment of the brightness and the color temperature of the display panel according to the brightness of the ambient light. In addition, based on the configuration mode and the process of the composite pixel units in the display panel and the optical detection modules therein, the optical detection modules not only can realize the function of detecting the brightness of the ambient light but also will not occupy the effective display area in the display panel.

For instance, the mode of executing the display operation and executing the optical signal acquisition operation in the display panel provided by the embodiment of the present disclosure can be configured by the designer, for instance, configured according to the scanning mode of the display panel, the configuration mode of the composite pixel unit, the size of the display panel, and the requirement on the sensitivity of the ambient light. In the driving method provided by the embodiment of the present disclosure, the display operation and the optical signal acquisition operation can be executed by means of presetting the scanning timing sequence. The implementations of the embodiment of the present disclosure will be illustrated below according to the setting modes of several scanning timing sequences.

In the setting mode of the first scanning timing sequence, the display panel is set to include n rows of pixel units, wherein at least a part of the pixel units in the $i^{th}$ row of pixel units are configured to be composite pixel units, in which i is a positive integer greater than or equal to 1, and n is a positive integer greater than or equal to i. In the implementation, the step of switching on the pixel structure to execute the display operation and switching on the optical detection module to execute the optical signal acquisition operation may include:

sequentially loading a first scanning signal, in the first period of each frame of time through gate lines from a gate line of the $1^{st}$ row of pixel units to a gate line of the $n^{th}$ row of pixel units, to sequentially switch on each row of pixel structures to execute the display operation, and loading a second scanning signal, in the second period of each frame of time through a gate line of the $i^{th}$ row of pixel units, to switch on the optical detection modules of the composite pixel units in the $i^{th}$ row of pixel units to execute the optical signal acquisition operation.

Figure 2A:
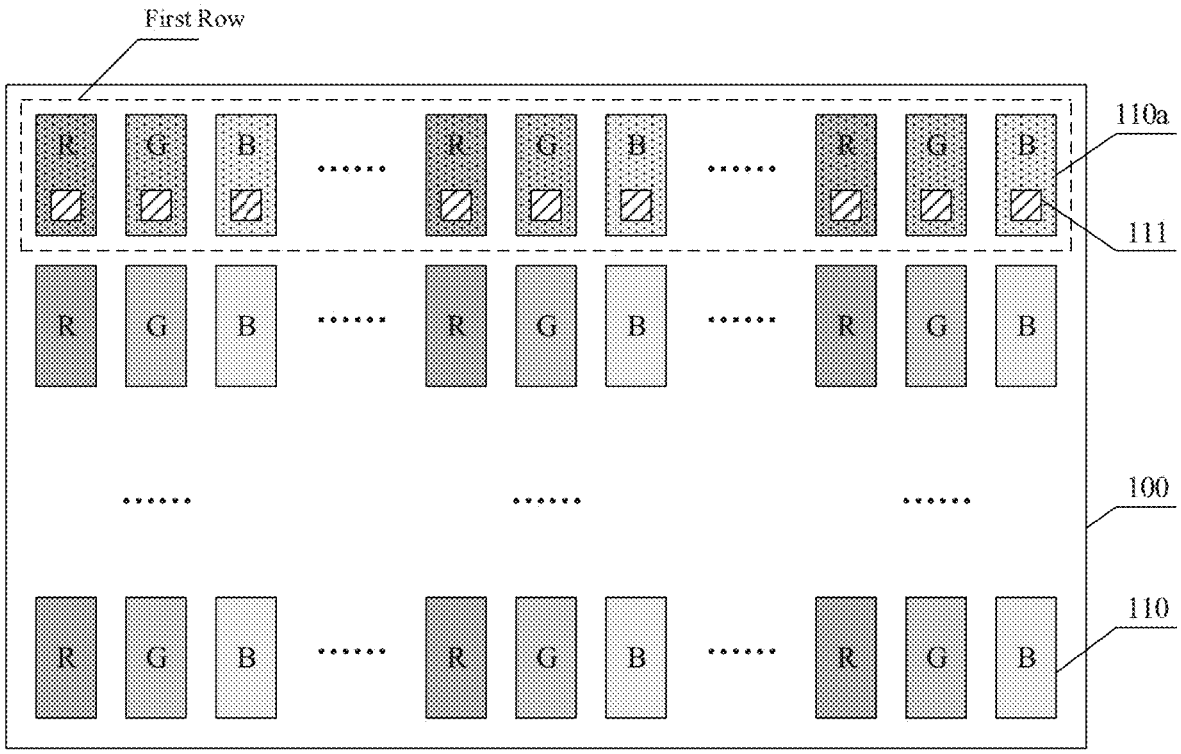
FIG. 2A is a schematic structural view of a display panel provided by an embodiment of the present disclosure.
Figure 2B:
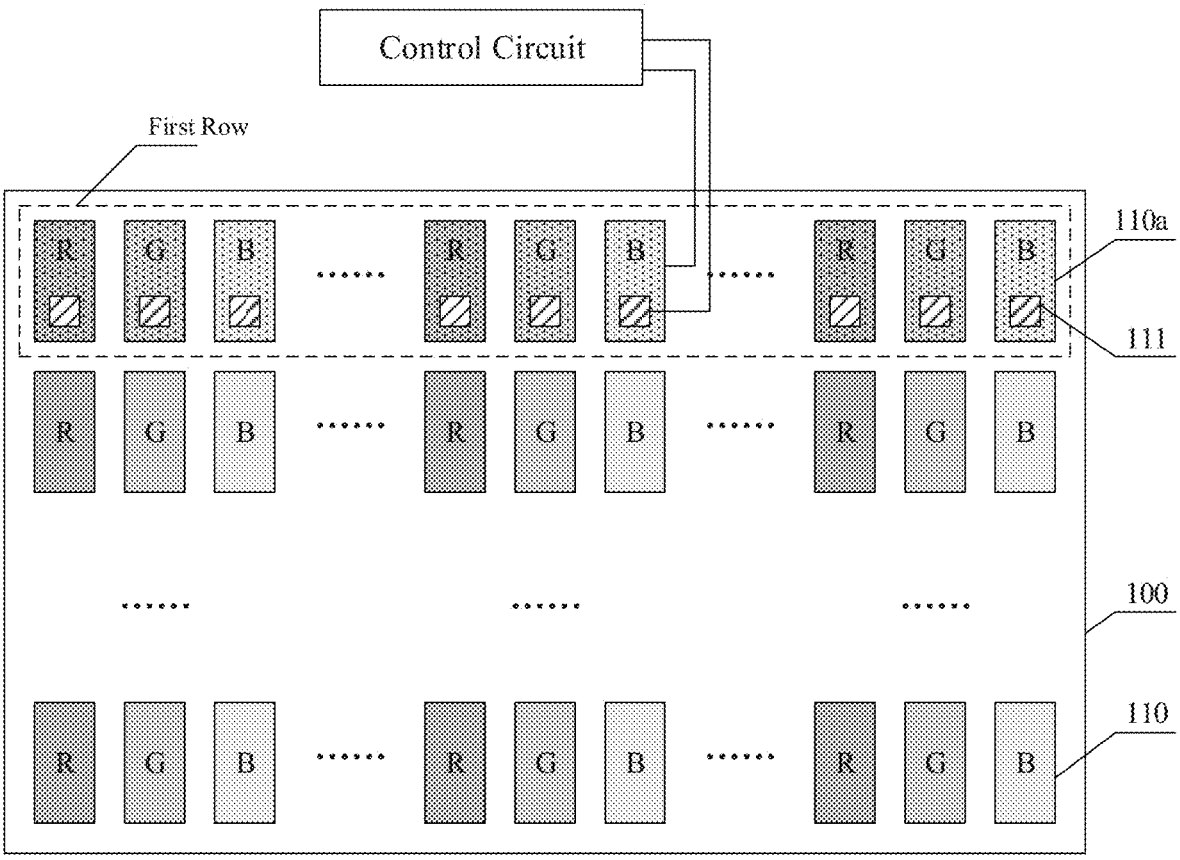
FIG. 2B is a schematic structural view of a display panel provided by an embodiment of the present disclosure.
Figure 8:
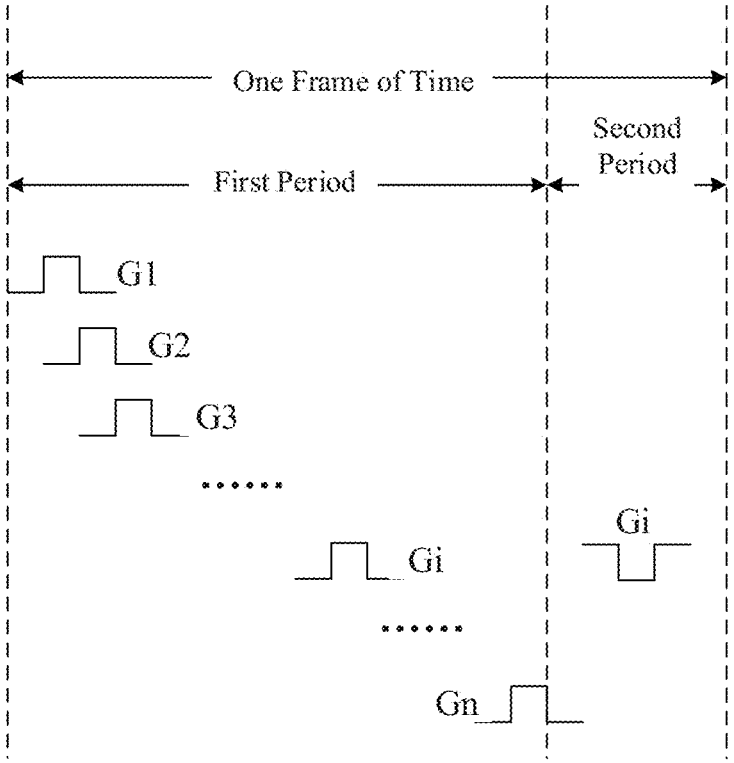
FIG. 8 is a schematic diagram of a driving timing sequence in the method for driving the display panel, provided by an embodiment of the present disclosure.

Taking the structure of the display panel 100 as shown in FIG. 2A as an example, the $1^{st}$ row of pixel units of the display panel are all configured to be composite pixel units. FIG. 8 is a schematic diagram of a driving timing sequence in the method for driving the display panel provided by the embodiment of the present disclosure. One frame of time is divided into display period (namely first period) and acquisition period (namely second period). In the first period, the first scanning signal is sequentially loaded through gate lines from a gate line of the $1^{st}$ row of pixel units (G1 in FIG. 8) to a gate line of the $n^{th}$ row of pixel units (Gn in FIG. 8), and the pixel structures in each row of pixel units from the $1^{st}$ row of pixel units to the $n^{th}$ row of pixel units are sequentially switched on to execute the display operation; and in the remaining time, namely the second period, a second scanning signal is loaded through a gate line of the $i^{th}$ row of pixel units (Gi in FIG. 8) to switch on the optical detection modules of the composite pixel units in the $i^{th}$ row of pixel units to execute the optical signal acquisition operation, and the acquired optical signal returns to a processing chip through the common electrode line Com, so as to sense the light intensity in the ambient light.

It should be noted that in the first scanning timing sequence, as only one row of pixel units in the display panel are provided with the composite pixel units, the gate line provided with the composite pixel units may only be scanned in the second period of each frame of time, so the scanning mode is simple and easy to realize. However, the distribution of the composite pixel units in this type of display panel is relatively concentrated. In the design requirement of the display panel with larger area, it may be required to uniformly distribute the composite pixel units in a plurality of areas of the display panel, so that the display panel can detect the brightness of the ambient light at various areas. The following describes the configuration mode of the scanning timing sequence in the application scene where a plurality of areas of the display panel are provided with the composite pixel units.

In the setting mode of the second scanning timing sequence, the display panel is also set to include n rows of pixel units, wherein in each row of pixel units of at least two rows of pixel units, at least a part of the pixel units are configured to be composite pixel units, and n is a positive integer greater than or equal to 2. In this implementation, the step of switching on the pixel structure to execute the display operation and switching on the optical detection module to execute the optical signal acquisition operation may include:

sequentially loading a first scanning signal, in the first period of each frame of time through gate lines from a gate line of the $1^{st}$ row of pixel units to a gate line of the $n^{th}$ row of pixel units, to sequentially switch on each row of pixel structures to execute the display operation, and sequentially loading a second scanning signal, in the second period of each frame of time through gate lines from a gate line of the $x^{th}$ row of pixel units to a gate line of the $y^{th}$ row of pixel units, to sequentially switch on the optical detection modules of the composite pixel units in each row of pixel units from the $x^{th}$ row of pixel units to the $y^{th}$ row of pixel units to execute the optical signal acquisition operation. The $x^{th}$ row of pixel units to the $y^{th}$ row of pixel units are configured to be the at least two rows of pixel units provided with the composite pixel units, in which x is a positive integer greater than or equal to 1 and less than or equal to y; y is a positive integer greater than x and less than or equal to n; and x to y may be serial numbers and may also be non-continuous numbers.

Figure 9:
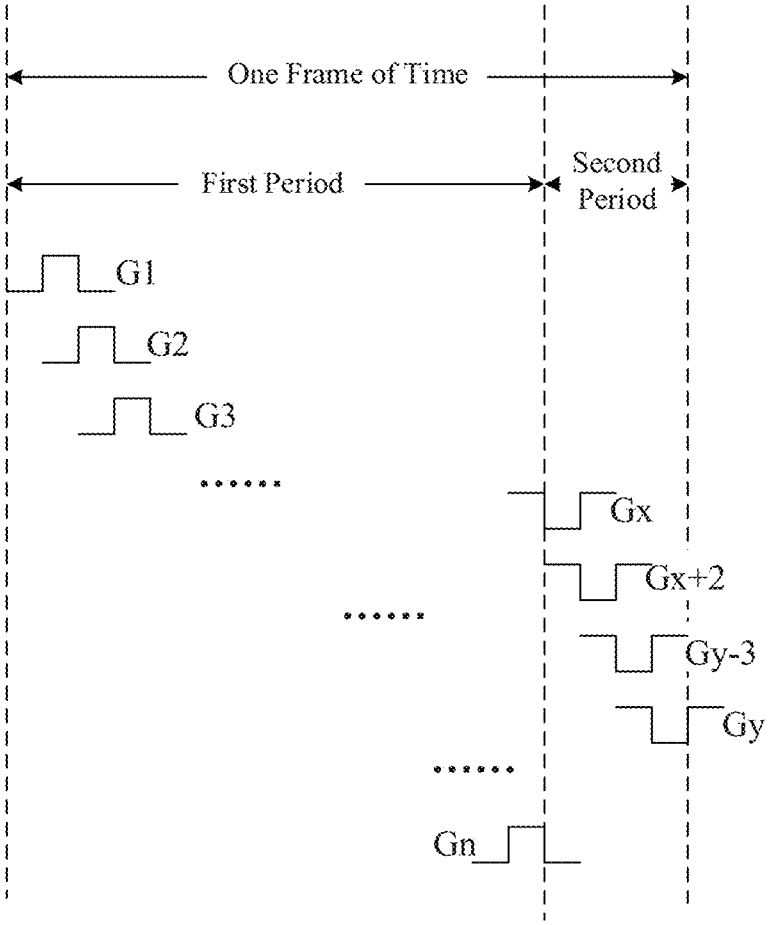
FIG. 9 is a schematic diagram of another driving timing sequence in a method for driving the display panel, provided by an embodiment of the present disclosure.

Taking the structure of the display panel 100 as shown In FIGS. 4-6 as an example, at least a part of the pixel units in a plurality of rows (namely multiple rows of pixel units) in the display panel are configured to be composite pixel units. As shown in FIG. 9 which is a schematic diagram of another driving timing sequence in the method for driving the display panel provided by the embodiment of the present disclosure, one frame of time is divided into display period (namely first period) and acquisition period (namely second period); in the first period, the first scanning signal is sequentially loaded, through gate lines from a gate line of the $1^{st}$ row of pixel units (G1 in FIG. 9) to a gate line of the $n^{th}$ row of pixel units (Gn in FIG. 9), to sequentially switch on the pixel structures in each row of pixel units from the $1^{st}$ row of pixel units to the $n^{th}$ row of pixel units to execute the display operation; in the remaining time, namely the second period, the second scanning signal is loaded, through gate lines from a gate line of the $x^{th}$ row of pixel units (Gx in FIG. 9) to a gate line of the $y^{th}$ row of pixel units (Gy in FIG. 9), to switch on the optical detection modules of the composite pixel units in each row of pixel units from the $x^{th}$ row of pixel units to the $y^{th}$ row of pixel units to execute the optical signal acquisition operation; and the acquired optical signal returns to the processing IC through the data line, so as to sense the light intensity of the ambient light. The driving timing sequence as shown in FIG. 9 is shown by taking the case that the $x^{th}$ row, the $(x+2)^{th}$ row, the $(y-3)^{th}$ row and the $y^{th}$ row are rows provided with composite pixel units as an example. For instance, as shown in FIG. 9, the potentials applied by the gate lines in the first period and the second period are opposite to each other, so that the pixel transistor and the phototransistor of different types can be switched on, respectively.

It should be noted that in the second scanning timing sequence, the $x^{th}$ row to the $y^{th}$ row may be rows with serial numbers and may also be rows with non-continuous numbers; the $x^{th}$ row to the $y^{th}$ row refer to all the rows provided with the composite pixel units in the display panel; in the second period, the optical detection modules in each row from the $x^{th}$ row to the $y^{th}$ row may be sequentially switched on through gate lines from Gx to Gy according to the preset scanning timing sequence; the scanning mode is similar to the scanning mode of executing the display operation, with the difference that only partial rows in the display panel may be switched on and the rows not provided with the composite pixel units are not required to be scanned in the second period.

In the setting mode of the third scanning timing sequence, the display panel is also set to include n rows of pixel units, wherein in each row of pixel units of at least two rows of pixel units, at least a part of the pixel units are configured to be composite pixel units, and n is a positive integer greater than or equal to 2. In this implementation, the step of switching on the pixel structure to execute the display operation and switching on the optical detection module to execute the optical signal acquisition operation may include:

in the scanning time of scanning the $z^{th}$ row of pixel units in each frame of time, sequentially loading a first scanning signal, in the first period through a gate line of the $z^{th}$ row of pixel units, to switch on the $z^{th}$ row of pixel structures to execute the display operation, and loading a second scanning signal, in the second period through the gate line of the $z^{th}$ row of pixel units, to switch on the optical detection modules of the composite pixel units in the $z^{th}$ row of pixel units to execute the optical signal acquisition operation, in which the $z^{th}$ row of pixel units is one of at least two rows of pixel units provided with composite pixel units, and z is a positive integer greater than or equal to 1 and less than or equal to n.

Figure 10:
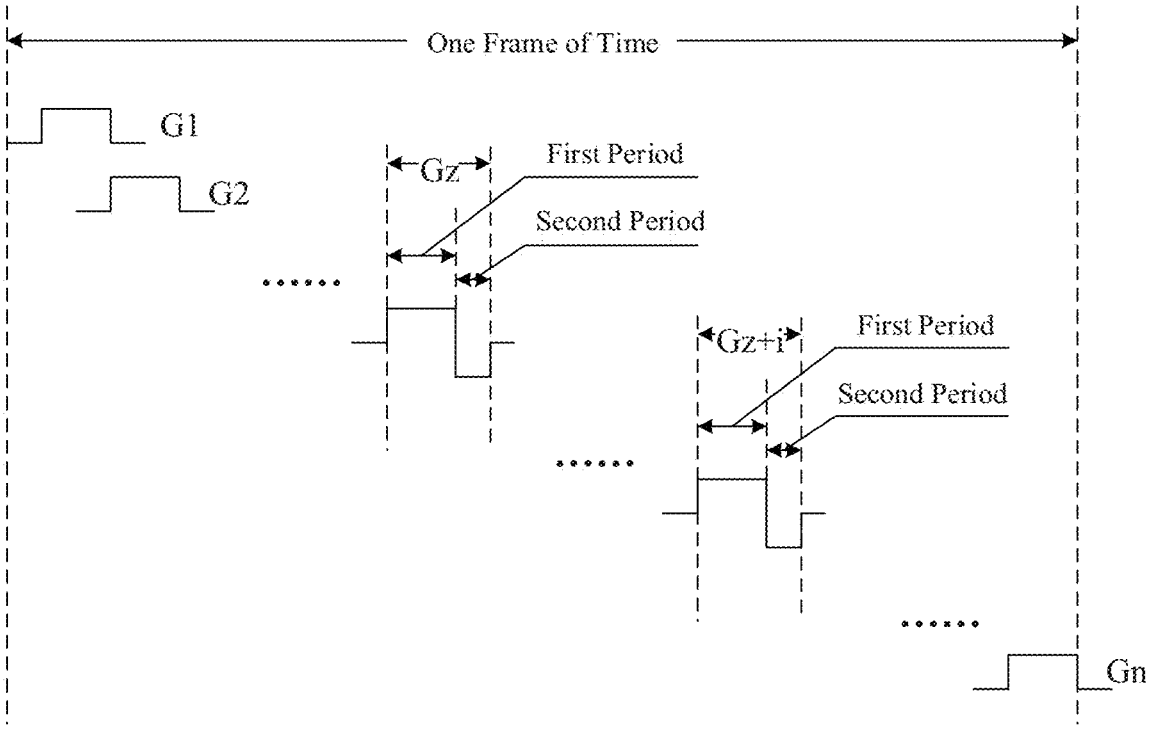
FIG. 10 is a schematic diagram of still another driving timing sequence in a method for driving the display panel, provided by an embodiment of the present disclosure.

Taking the structure of the display panel 100 as shown in FIGS. 4-6 as an example, at least a part of the pixel units in a plurality of rows (namely multiple rows of pixel units) in the display panel are configured to be composite pixel units. FIG. 10 is a schematic diagram of still another driving timing sequence in the method for driving the display panel provided by the embodiment of the present disclosure. In the above two scanning timing sequences, one frame of time is divided, and within one frame of time, not only all the rows of the display panel must be scanned to execute the display operation but also all the rows provided with the composite pixel units must be scanned to execute the acquisition operation. In the third scanning timing sequence, in the process of scanning the rows of the display panel within one frame of time, as for the rows not provided with the composite pixel units, the pixel units are only switched on to execute the display operation; as for the rows provided with the composite pixel units, the scanning time of this row is divided into display period (namely first period) and acquisition period (namely second period); in the first period, the first scanning signal is loaded through a gate line of the $z^{th}$ row of pixel units (Gz in FIG. 10) to switch on the pixel structures of the $z^{th}$ row of pixel units to execute the display operation; in the remaining time, namely the second period, the second scanning signal is also loaded through the gate line of the $z^{th}$ row of pixel units (Gz in FIG. 10) to switch on the optical detection modules of the composite pixel units in the $z^{th}$ row of pixel units to execute the optical signal acquisition operation; and the acquired optical signal returns to the processing IC through the data line, so as to sense the light intensity of the ambient light. For instance, the gate lines are respectively loaded with opposite potentials, so as to respectively switch on the pixel transistor and the phototransistor. The driving timing sequence as shown in FIG. 10 is shown by taking the case that the $z^{th}$ row and the $(z+i)^{th}$ row are rows provided with composite pixel units as an example.

It should be noted that in the third scanning timing sequence, only the scanning mode of one row (namely the $z^{th}$ row of pixel units) provided with the composite pixel units is described. As for other pixel units provided with the composite pixel units, the scanning mode is the same with the above scanning mode of the $z^{th}$ row of pixel units. In the scanning timing sequence as shown in FIG. 10, the scanning timing sequence of the $z^{th}$ row of pixel units and the $(z+i)^{th}$ row of pixel units is the display period added with the acquisition period. Other rows are shown by taking the rows not provided with the composite pixel units as an example.

In addition, as for the above driving method, the voltage required for switching on the pixel transistor may be not applied to gate lines corresponding to the optical detection modules at the second period. For instance, common voltage signals may be applied. At this point, the acquired signal is outputted from the data line, without affecting the display of pixels.

Based on the display panel 100 provided by the embodiment of the present disclosure, the embodiment of the present disclosure further provides a method for manufacturing a display panel. The method for manufacturing the display panel may be used for manufacturing the display panel provided by any foregoing embodiment. The method for manufacturing the display panel may comprise the following steps:

forming pixel structures of pixel units in the display panel, in which at least a part of the pixel units are configured to be composite pixel units, and each of the composite pixel units includes the pixel structure and an optical detection module. For example, the pixel structure and the optical detection module are formed simultaneously.

The display panel manufactured by the embodiment of the present disclosure has the function of automatically adjusting the brightness according to the brightness of the ambient light. Therefore, a functional module for detecting the brightness of the ambient light is integrated into the display panel, but the functional module is not the ambient light sensor disposed in the non-display area (for instance, the "notch area" in FIG. 1) of the display panel, but the functional module is integrated into at least a part of the pixel units (namely the composite pixel units) of the display panel.

In the embodiment of the present disclosure, the composite pixel unit has the structural characteristics of the conventional pixel unit (namely the composite pixel unit includes the pixel structure), and is integrated with the optical detection module on the basis of the structure of the conventional pixel unit. The optical detection module is, for instance, a transistor having photosensitivity. As the pixel structure for controlling the switching of the pixel unit in the display panel includes the pixel transistor such as the TFT, based on the characteristic that the structures of the phototransistor and the pixel transistor are similar, the method provided by the embodiment of the present disclosure may further comprise:

forming the optical detection modules in the composite pixel units simultaneously with forming the above pixel structures.

That is to say, in the manufacturing method provided by the embodiment of the present disclosure, the optical detection modules can be simultaneously manufactured in the process of manufacturing the pixel transistors of the display panel, and the optical detection module can be simultaneously manufactured only by opening up a small area space in the composite pixel unit. Therefore, the forming mode of the optical detection module for detecting the brightness of the ambient light in the embodiment of the present disclosure may be that: in the conventional manufacturing process of the display panel, the optical detection modules are simultaneously manufactured, so as to integrate the optical detection modules into the display panel; and the manufactured optical detection module not only can realize the function of detecting the brightness of the ambient light but also will not occupy the area of the effective display area in the display panel, that is, as for the display panel, the optical detection module is completely invisible.

In the display panel manufactured by the manufacturing method provided by the embodiment of the present disclosure, based on the manner and the position of forming the optical detection module, and the process of forming the optical detection module, on one hand, it is possible to avoid the influence of the arrangement of the ambient light sensor at the non-display area of the display panel on the effective display area, realize the integration of more components into the display panel, improve the proportion of the display area, and realize a true full screen. On the other hand, the embodiment can reduce the assembly process required for arranging the ambient light sensor on the outside of the display panel, simplify the process flow, reduce the production cost of the display panel by optimizing the process and the design, facilitate the integration of the industrial chain, and improve the added value of display panel.

In the method for manufacturing the display panel provided by the embodiment of the present disclosure, based on the structural characteristics of the display panel provided by any foregoing embodiment as shown in FIGS. 2A-6, the optical detection modules of the composite pixel units can be simultaneously manufactured in the process of manufacturing the pixel structures of the pixel units in the display panel, wherein at least a part of pixel units are configured to be the composite pixel units, and each of the composite pixel units includes the pixel structure and the optical detection module. The composite pixel unit can switch on the pixel structures to execute the display operation in the first period and switch on the optical detection modules to execute the optical signal acquisition operation in the second period. Based on the structural characteristic that the optical detection module is integrated into the composite pixel unit, the method for manufacturing the display panel provided by the embodiment of the present disclosure can simultaneously manufacture the optical detection modules in the conventional manufacturing process of the display panel, so as to integrate the optical detection modules into the display panel. The formed optical detection modules not only can realize the function of detecting the brightness of the ambient light but also will not occupy the effective display area in the display panel. On one hand, as the display panel is manufactured by the manufacturing method, the duty ratio of the display area in the display panel can be improved, being beneficial to realize the true full screen. On the other hand, the optical detection modules and the pixel structures can be simultaneously manufactured, so the manufacturing process is simple, and the production cost of the display panel can be reduced, thereby being favorable for the integration of the industrial chain.

It should be noted that the method for manufacturing the display panel provided by the embodiment of the present disclosure not only comprises the processing steps of forming the pixel structures and the optical detection modules but also comprises other processing steps of manufacturing the display panel, and other processing steps are determined according to the specific structure of the display panel. For instance, the display panel is a liquid crystal display (LCD) panel, an organic light-emitting diode (OLED) panel, or other types of display panels. The manufacturing processes are all different from each other. The manufacturing method provided by the embodiment of the present disclosure mainly describes in details the main improved structure in the display panel provided by the foregoing embodiments of the present disclosure (i.e., the forming mode of the optical detection module for detecting the brightness of the ambient light). The manufacturing modes of other structures of the display panel are not described in detail in the embodiment of the present disclosure.

In the display panel manufactured by the manufacturing method provided by the embodiment of the present disclosure, the pixel structure includes a pixel electrode and a pixel transistor (for instance, being a pixel TFT), and the optical detection module includes a phototransistor (for instance, being a photosensitive TFT).

Figure 11:
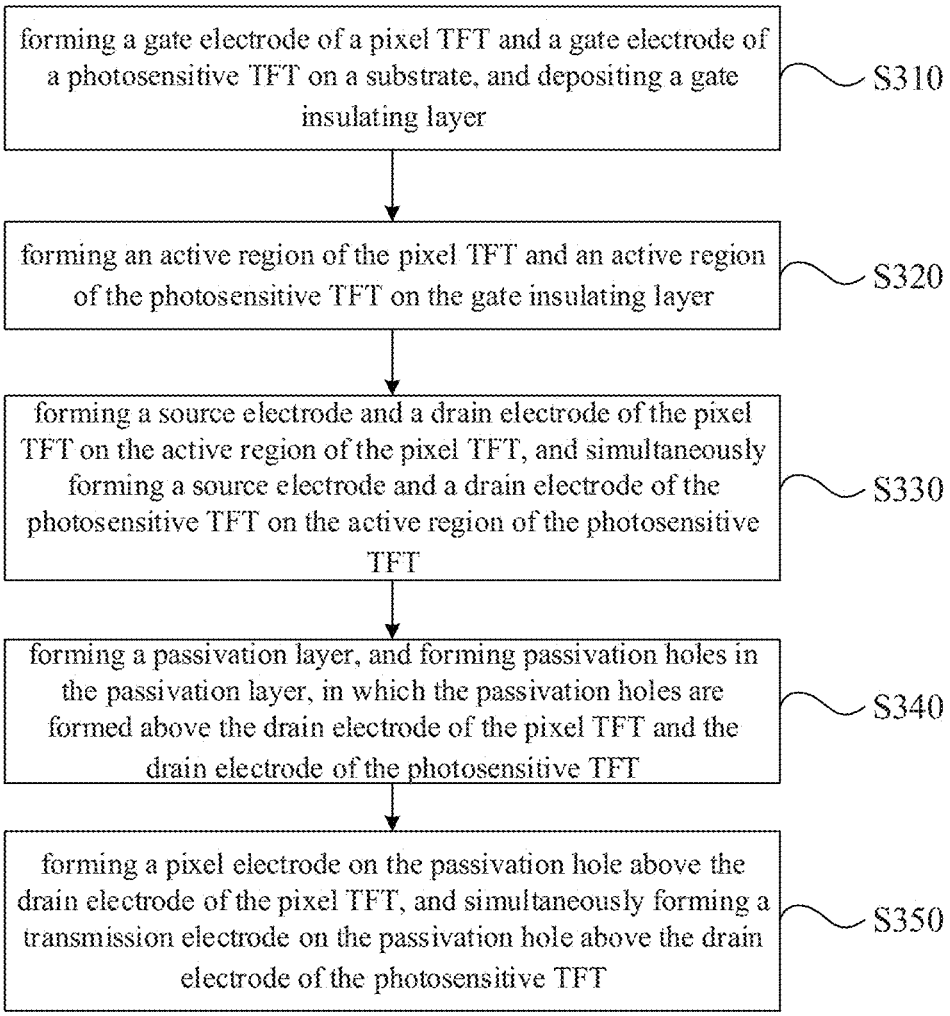
FIG. 11 is a flowchart of a method for manufacturing a display panel, provided by an embodiment of the present disclosure.

In one implementation of the embodiment of the present disclosure, FIG. 11 is a flowchart of a method for manufacturing a display panel provided by the embodiment of the present disclosure. The above step of forming the pixel structures and the optical detection modules may include the following steps:

S310: forming a gate electrode of a pixel TFT and a gate electrode of a photosensitive TFT on a substrate, and depositing a gate insulating layer;

S320: forming an active region of the pixel TFT and an active region of the photosensitive TFT on the gate insulating layer;

S330: forming a source electrode and a drain electrode of the pixel TFT on the active region of the pixel TFT, and simultaneously forming a source electrode and a drain electrode of the photosensitive TFT on the active region of the photosensitive TFT, in which in order to improve the photosensitivity of the photosensitive TFT, the channel length of the photosensitive TFT is usually required to be larger than the channel length of the pixel TFT, so that the exposed area of the channel region in the photosensitive TFT is larger, the area of photosensitive materials is larger, and the information acquisition amount is also larger;

S340: forming a passivation layer, and forming passivation holes in the passivation layer, in which the passivation holes are formed above the drain electrode of the pixel TFT and the drain electrode of the photosensitive TFT; and S350: forming a pixel electrode on the passivation hole above the drain electrode of the pixel TFT, and simultaneously forming a transmission electrode on the passivation hole above the drain electrode of the photosensitive TFT.

Figure 12:
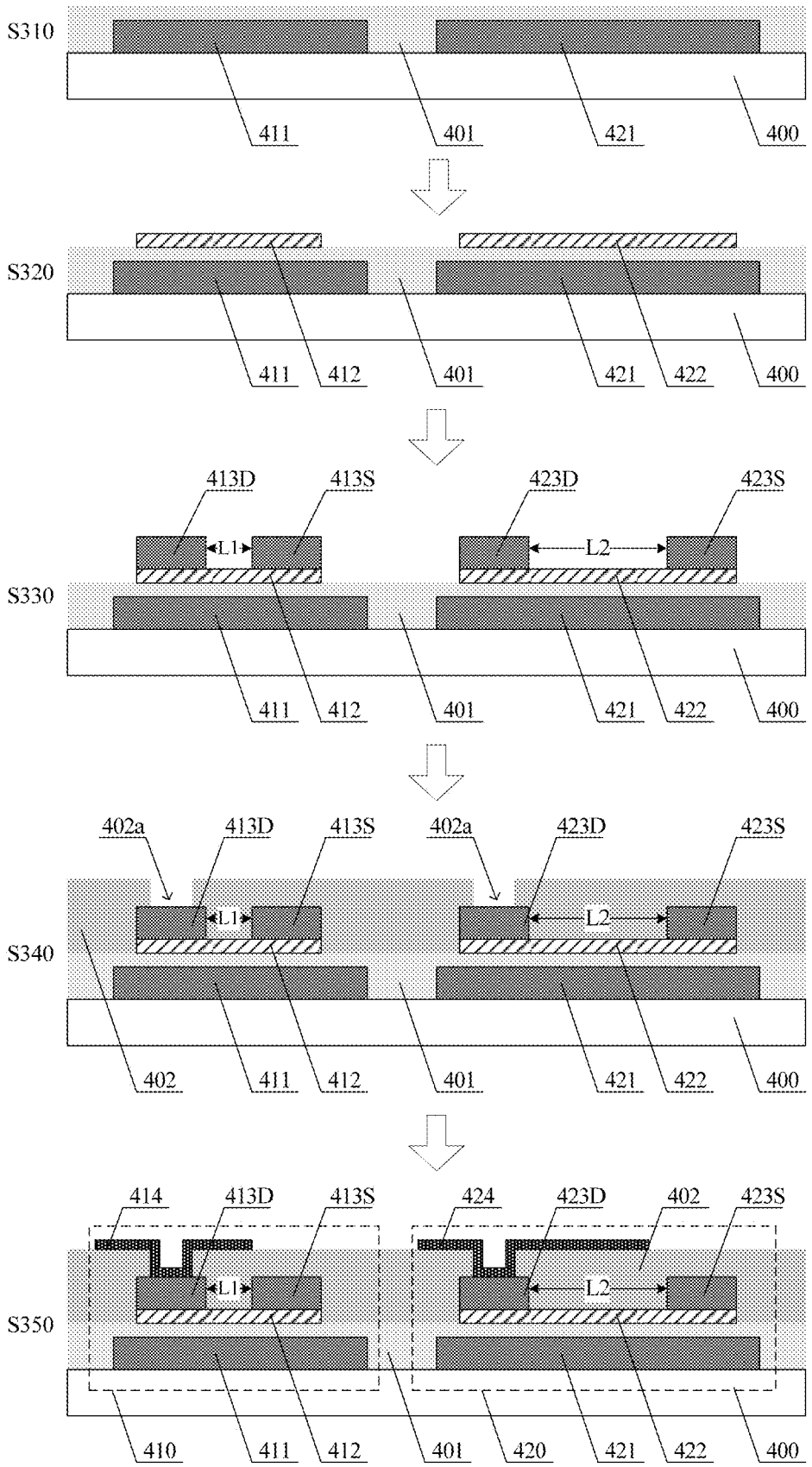
FIG. 12 is a schematic diagram of a process in a method for manufacturing the display panel, provided by an embodiment as shown in FIG. 11.

In the manufacturing method provided by the embodiment of the present disclosure, both the formed pixel structure and the formed optical detection module are actually a TFT. Thus, in the manufacturing process, the pixel TFT and the photosensitive TFT in the display panel can be simultaneously manufactured. FIG. 12 is a schematic diagram of a process in the method for manufacturing the display panel provided by the embodiment as shown in FIG. 11. FIG. 12 shows one pixel TFT 410 and one photosensitive TFT 420 in the display panel. The structure of the pixel TFT 410 is basically the same with the structure of the photosensitive TFT 420. Moreover, both the pixel TFT 410 and the photosensitive TFT 420 manufactured by the process as shown in FIG. 12 adopt bottom-gate process. The manufacturing process includes: firstly, forming a gate electrode layer on a substrate 400, forming a gate electrode 411 of the pixel TFT 410 and a gate electrode 421 of the photosensitive TFT 420 by a patterning process, and depositing a gate insulating layer 401 covering the above gate electrodes; secondly, simultaneously forming the active region 412 of the pixel TFT 410 and the active region 422 of the photosensitive TFT 420 on the gate insulating layer, in which the means of forming the active regions is also the process of forming an active layer and forming the active region of each TFT by patterning process, and the active region of each TFT is disposed over the gate electrode thereof; thirdly, simultaneously forming a source electrode 413S and a drain electrode 413D of the pixel TFT 410 by similar process of forming the film layer and the patterning process, in which the spacing between the source electrode and the drain electrode in each TFT is the channel length of the TFT, and the active region thereof is also referred to as a channel layer; fourthly, depositing a passivation layer 402 on the formed elements, and forming passivation holes 402*a* for communicating the electrodes in the TFTs in the passivation layer 402 also by patterning process, for subsequent wiring; and finally, forming a pixel electrode 414 of the pixel TFT 410 and simultaneously forming a transmission electrode 424 of the photosensitive TFT 420 by the process of forming the electrode film layer and the patterning process, in which the pixel electrode 414 and the transmission electrode 424 may be made from transparent indium tin oxide (ITO).

As shown in FIG. 12, the gate electrode, the active layer and the source/drain electrodes of the pixel transistor and the gate electrode, the active layer and the source/drain electrodes of the photosensitive transistor are arranged in the same layer, respectively. "Arranged in the same layer" indicates that patterns arranged in the same layer may be formed by deposition of the same material layer and the subsequent patterning process.

It should be noted that the difference between the pixel TFT 410 and the photosensitive TFT 420 manufactured by the manufacturing method provided by the embodiment of the present disclosure is that the channel length L2 of the photosensitive TFT 420 is greater than the channel length L1 of the pixel TFT 410, as shown in FIG. 12. In addition, in the aspect of the material selection of the channel layer (namely the active region 422), on one hand, it is necessary to meet the functional requirements for realizing display, that is, having high electron mobility and the like; and on the other hand, it is necessary to satisfy the requirement of having or partially having photovoltaic effect on a spectrum having a wavelength of 300 nm to 2,000 nm so as to satisfy the optical detection capability of the photosensitive TFT 420.

Figure 13:
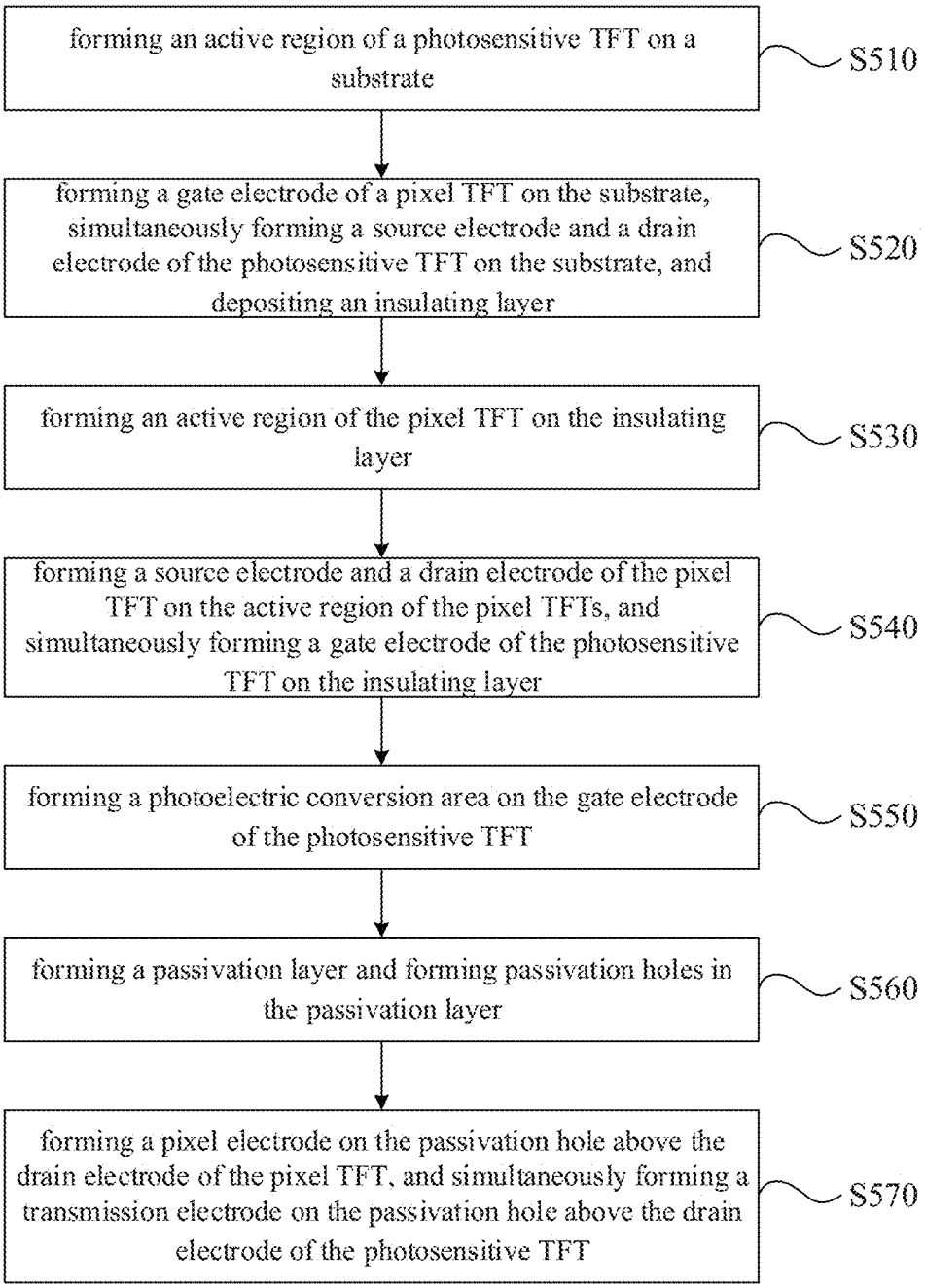
FIG. 13 is a flowchart of another method for manufacturing a display panel, provided by an embodiment of the present disclosure.

In another implementation of the embodiment of the present disclosure, FIG. 13 is a flowchart of another method for manufacturing a display panel provided by the embodiment of the present disclosure. The above process of forming the pixel structures and the optical detection module may include the following steps:

S510: forming an active region of a photosensitive TFT on a substrate.

S520: forming a gate electrode of a pixel TFT on the substrate, simultaneously forming a source electrode and a drain electrode of the photosensitive TFT on the substrate, and depositing an insulating layer.

S530: forming an active region of the pixel TFT on the insulating layer.

S540: forming a source electrode and a drain electrode of the pixel TFT on the active region of the pixel TFTs, and simultaneously forming a gate electrode of the photosensitive TFT on the insulating layer.

S550: forming a photoelectric conversion area on the gate electrode of the photosensitive TFT, in which the photoelectric conversion area is configured to acquire an optical signal.

S560: forming a passivation layer and forming passivation holes in the passivation layer, in which the passivation holes are formed above the drain electrode of the pixel TFT and above the source electrode and the drain electrode of the photosensitive TFT. It should be noted that as the source electrode of the photosensitive TFT is arranged in the same layer with a data line in the manufacturing process, compared with the process as shown in FIG. 12, the passivation hole must also be formed above the source electrode of the photosensitive TFT to connect the source electrode and the data line.

S570: forming a pixel electrode on the passivation hole above the drain electrode of the pixel TFT, and simultaneously forming a transmission electrode on the passivation hole above the drain electrode of the photosensitive TFT.

Figure 14:
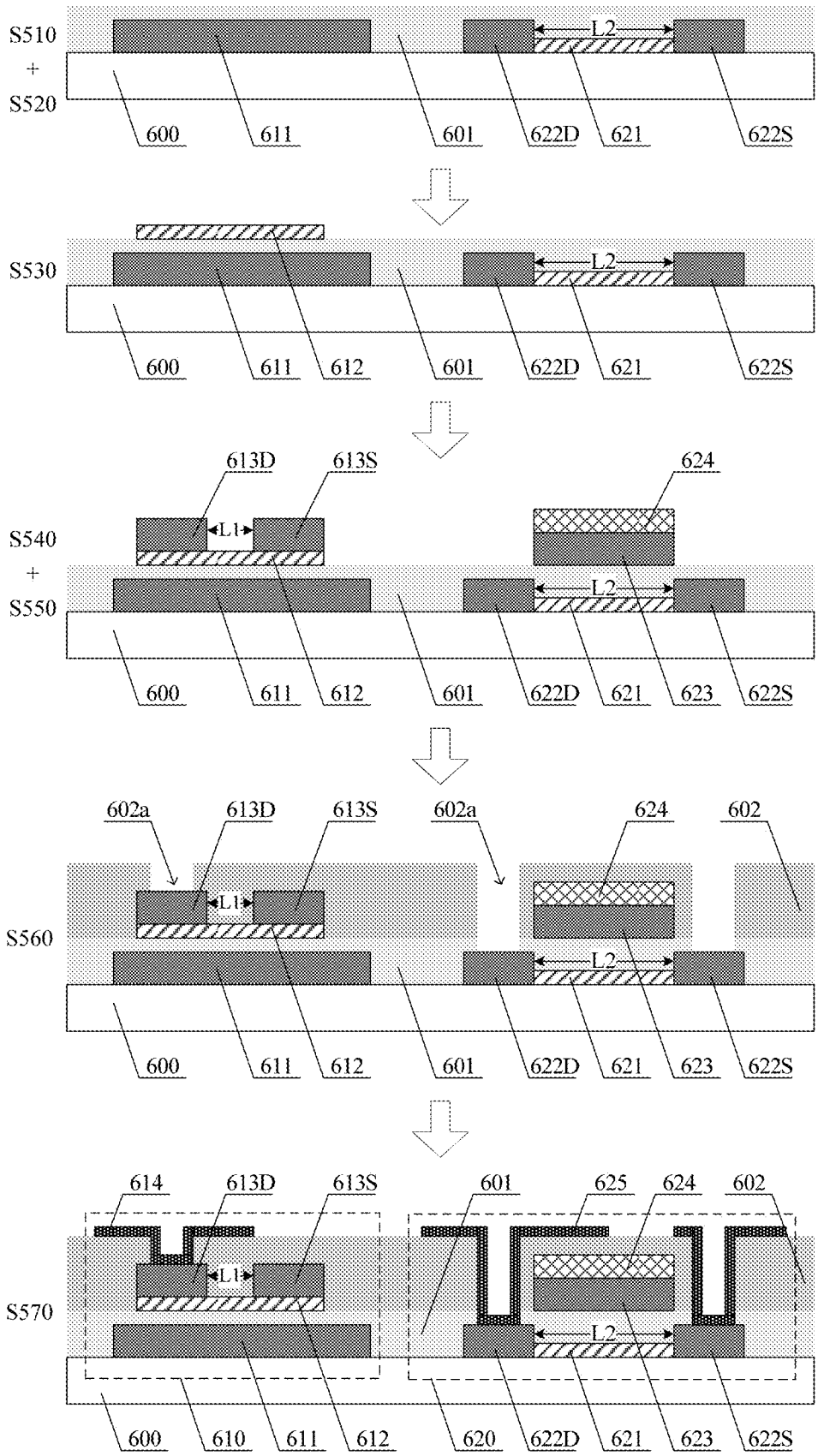
FIG. 14 is a schematic diagram of a process in the method for manufacturing the display panel, provided by the embodiment as shown in FIG. 13.

In the manufacturing method provided by the embodiment of the present disclosure, as both the formed pixel structure and the formed optical detection module are actually a TFT, in the manufacturing process, the pixel TFT and the photosensitive TFT in the display panel may be simultaneously manufactured. FIG. 14 is a schematic diagram of a process in the method for manufacturing the display panel provided by the embodiment as shown in FIG. 13. FIG. 14 shows one pixel TFT 610 and one photosensitive TFT 620 in the display panel. The structure of the pixel TFT 610 has certain difference from the structure of the photosensitive TFT 620. The pixel TFT 610 manufactured by the process as shown in FIG. 14 adopts bottom-gate process, and the photosensitive TFT 620 adopts top-gate process. The manufacturing process includes: firstly, forming a semiconductor layer on a substrate 600, and forming an active region 621 of the photosensitive TFT 620 by patterning process, in which the material of the active region 621 may select amorphous silica (a-Si) or low-temperature polysilicon (LTPS) materials; secondly, forming a metal electrode layer on the substrate 600, simultaneously forming a gate electrode 611 of the pixel TFTs 610 and the source electrode 622S and the drain electrode 622D of the photosensitive TFT 620 by patterning process, and forming an insulating layer 601 covering the above electrodes by plasma enhanced chemical vapor deposition (PECVD) method or vapor deposition method; thirdly, forming a semiconductor metal layer again, and forming an active region 612 of the pixel TFT 610 by patterning process, in which the active region 612 is taken as a channel of the TFT 610 and may also be made from LTPS materials; thirdly, forming a metal electrode layer again, and simultaneously forming a source electrode 613S and a drain electrode 613D of the pixel TFT 610 and a gate electrode 623 of the photosensitive TFT 620 by patterning process, in which the spacing between the source electrode and the drain electrode in each TFT is the channel length of the TFT; and finally, forming a photoelectric conversion layer of the photosensitive TFT 620 by vapor deposition method, sputtering process, spin coating or other means, and forming a photoelectric conversion area 624 by patterning process, in which the photoelectric conversion area 624 is formed over the gate electrode 623. In the subsequent process, the processes of forming a passivation layer 602 and passivation holes 602*a* and forming a pixel electrode 614 of the pixel TFT 610 and a transmission electrode 625 of the photosensitive TFT 620 are the same with the processes as shown in FIG. 12, and the function and the material of the pixel electrode 614 and the transmission electrode 625 are also the same with those in the above embodiment, so no further description will be given here.

As shown in FIG. 14, partial structural layers of the pixel transistor and the phototransistor are arranged in the same layer. However, no matter the structure formed in FIG. 12 or the structure formed in FIG. 14, both can be considered as that the two transistors are arranged in the same layer. That is to say, the transistors are formed on the same layer. "Formed on the same layer" indicates that both the pixel transistor taken as a whole and the phototransistor taken as a whole respectively make contact with the same layer, not limited to which specific part in the pixel transistor or the phototransistor makes contact with the same layer. Therefore, the pixel transistor and the phototransistor can be simultaneously formed.

In the process shown in FIG. 14, the phototransistor is of a top gate type. The active region (active layer) 621 is located at a side of the gate electrode 623 close to the substrate 600. Therefore, the ambient light is blocked from being received by the active region. In the structure produced by the process of FIG. 14, the light conversion layer 624 is disposed on a side of the gate electrode 623 away from the active region. In this case, the light conversion layer 624 forms a Schottky junction, and an electric field is formed between the light conversion layer 624 and the gate electrode 623. Under the influence of charges accumulated in the gate electrode 623, the conductivity of the active region 621 will be changed accordingly. Therefore, the source electrode 622S and the drain electrode 622D of the phototransistor can be connected with the data line and the common electrode line, respectively. A drive signal can be input by one of the data line and the common electrode line, and a detection signal is output from the other one of the data line and the common electrode line, so as to detect the light intensity.

In the present disclosure, the process as shown in FIG. 12 is shown by taking the case that both the pixel TFT 410 and the photosensitive TFT 420 adopt bottom-gate process as an example, and the process as shown in FIG. 14 is shown by taking the case that the pixel TFT 610 adopts bottom-gate process and the photosensitive TFT 620 adopts top-gate process as an example. In actual processes, the pixel TFT may also adopt top-gate process and the photosensitive TFT 620 may also adopt bottom-gate process, or both the pixel TFT and the photosensitive TFT adopt top-gate process. As the technological processes are similar to those in the above embodiment, no further description will be given here.

It should be noted that the difference between the pixel TFT 610 and the photosensitive TFT 620 manufactured by the process of the embodiment as shown in FIG. 14 of the present disclosure is that: on one hand, the channel length L2 of the photosensitive TFT 620 is greater than the channel length L1 of the pixel TFT 610; as shown in FIG. 14, the photoelectric conversion area 624 are formed on the gate electrode 623 of the photosensitive TFT 620, and the photoelectric conversion area 624 is configured to acquire an optical signal; on the other hand, as can be seen from FIG. 14, the pixel TFT 610 adopts bottom-gate process and the photosensitive TFT 620 adopts top-gate process; in the process of forming the passivation holes, the height of the passivation holes in the pixel TFT 610 and the photosensitive TFT 620 is different; as the source electrode 622S of the photosensitive TFT 620 and the data line thereof are not arranged in the same process layer, the passivation hole is also formed above the source electrode 622S and may connect the source electrode 622S and the data line in the subsequent wiring process. In addition, the material selection of the active region 621 is similar to that in the above embodiment, so no further description will be given here.

Figure 15:
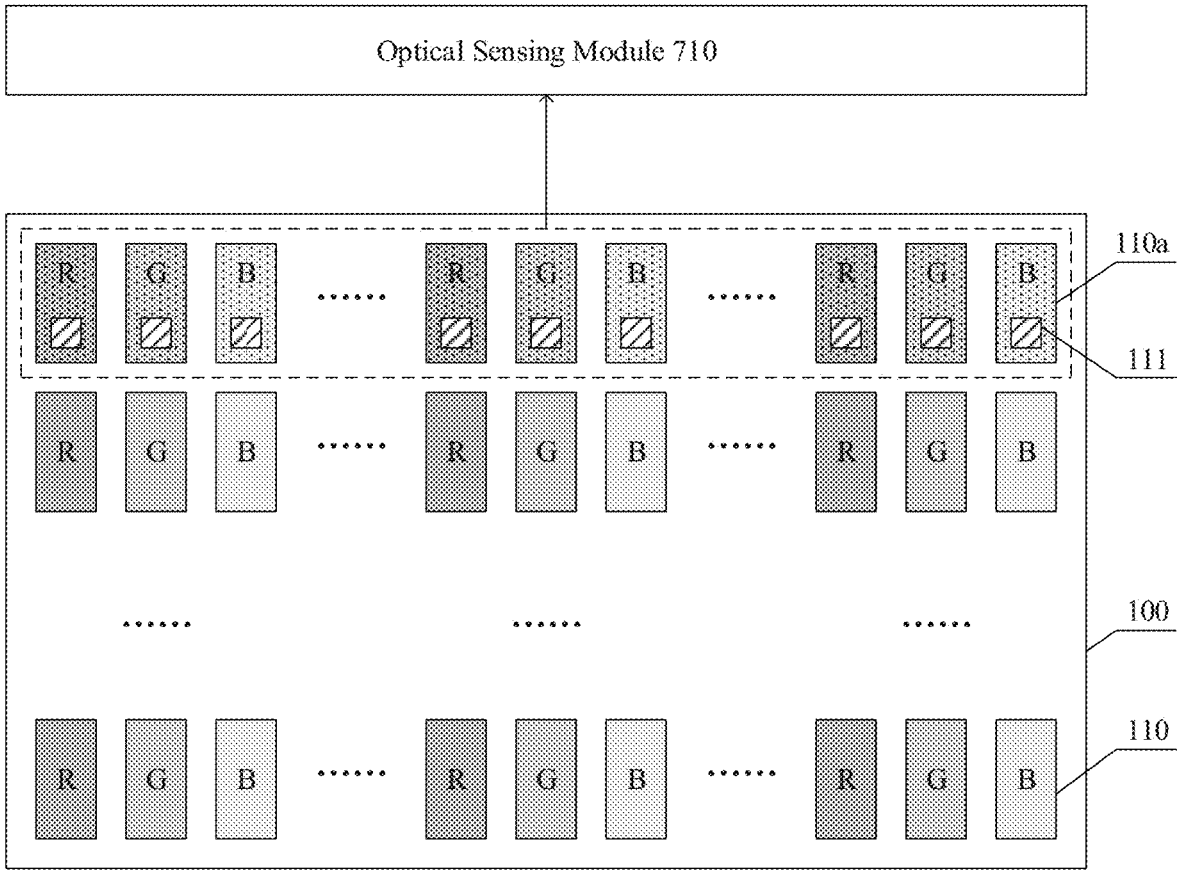
FIG. 15 is a schematic structural view of a display device provided by an embodiment of the present disclosure.

Based on the display panel 100 provided by the embodiment of the present disclosure, the embodiment of the present disclosure further provides a display device. FIG. 15 is a schematic structural view of a display device provided by the embodiment of the present disclosure. The display device provided by the embodiment of the present disclosure may comprise: the display panel 100 provided by any embodiment as shown inn FIGS. 2A to 6, and an optical sensing module 710 connected with the optical detection modules 111 in the composite pixel units 10*a* of the display panel 100. In the embodiment of the present disclosure, the optical detection module 111 may be connected with the optical sensing module 710 through output terminals thereof (namely common electrode lines Com). As shown in FIG. 15 by taking the structure of the display panel 100 as shown in FIG. 2 as an example, the display panel 100 in the display device may adopt the display panel 100 provided by any foregoing embodiment of the present disclosure. The structural characteristics of the display panel 100, the mode of arranging the composite pixel units in the display panel, and the realized functions of the pixel units, the composite pixel units and the optical detection modules have been described in detail in the above embodiment, so no further description will be given here.

In the display device provided by the embodiment of the present disclosure, the optical sensing module 710 is configured to receive optical signals acquired by the optical detection modules 111, and generate adjustment values for adjusting the brightness of the display panel 100 according to the optical signals.

The display device provided by the embodiment of the present disclosure has the function of automatically adjusting the brightness according to the brightness of the ambient light. The function of automatically adjusting the brightness is executed by the optical detection module 111 in the display panel 100 and the processing chip in the display device. The optical sensing module 710 is a module for signal processing in the display device. The optical detection module 111 is connected with the optical sensing module 710 through a peripheral lead, and transmits the acquired optical signal to the optical sensing module 710. After the optical signal is checked with a standard sample, the optical sensing module 710 generates the adjustment value for adjusting the brightness of the display panel 100.

The display device provided by the embodiment of the present disclosure comprises the display panel provided by any embodiment as shown in FIGS. 2A to 6, and an optical sensing module 710 connected with the optical detection modules 111 in the composite pixel units 110*a* of the display panel 100. The optical sensing module 710 may generate adjustment values for adjusting the brightness of the display panel according to the optical signals received from the optical detection modules 111. The operations executed by the optical detection module 111 are the same with those in the above embodiment, that is, the optical detection module 111 may be switched on in the second period to execute the optical signal acquisition operation. In the display device provided by the embodiment of the present disclosure, based on the structure and the function of the composite pixel unit 110*a* in the display panel 100, optical signals may be acquired by the optical detection modules 111 in the display panel 100 and taken as the basis for adjusting the brightness of the display panel 100. The display device adopts the display panel 100 provided by the embodiment of the present disclosure and has the same technical effects with the above embodiment, so no further description will be given here.

Figure 16:
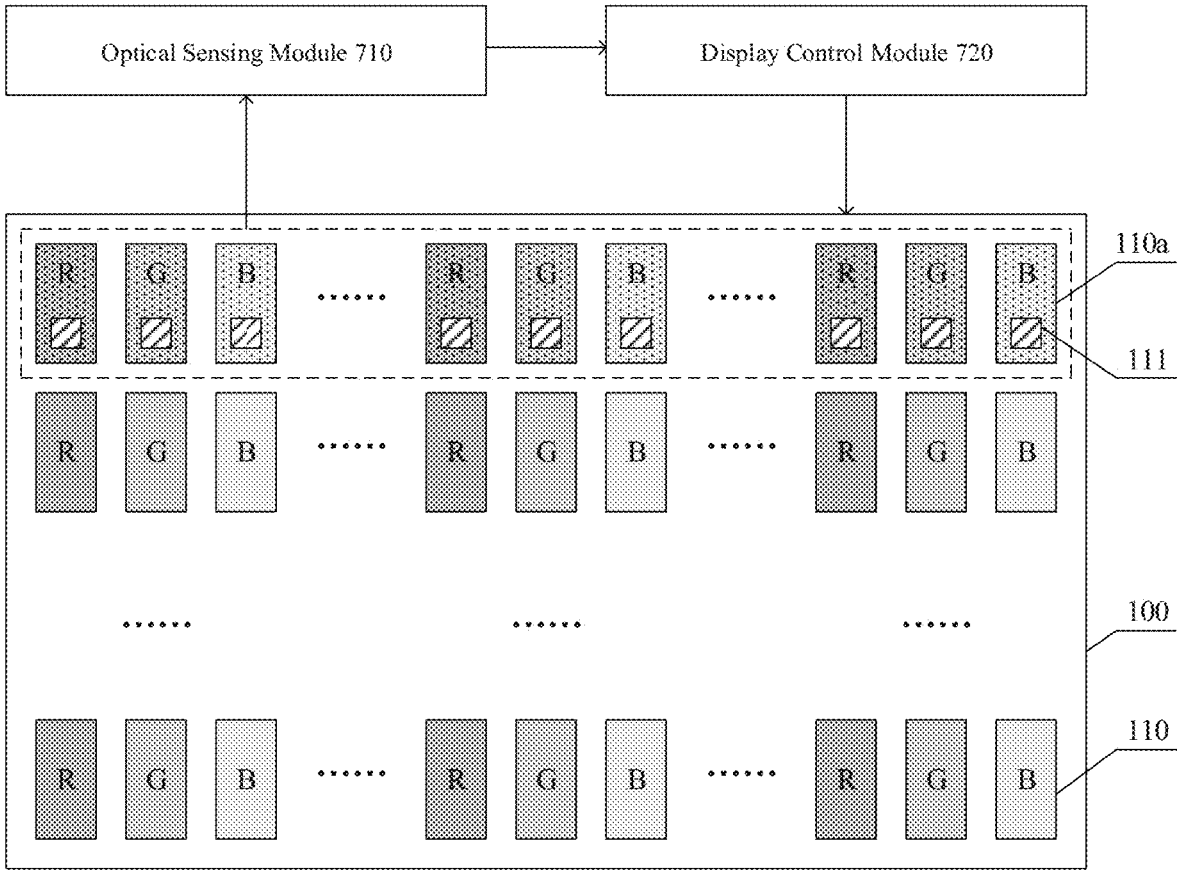
FIG. 16 is a schematic structural view of another display device provided by an embodiment of the present disclosure.

Optionally, FIG. 16 is a schematic structural view of another display device provided by the embodiment of the present disclosure. On the basis of the structure of the display device as shown in FIG. 15, the display device provided by the embodiment of the present disclosure may further comprise:

a display control module 720 connected with the optical sensing module 710 and configured to receive the adjustment values generated by the optical sensing module 710 and adjust the brightness of the pixel units 110 in the display panel 100 according to the adjustment values. The pixel units 110 of which the brightness is adjusted here also include the composite pixel units 110*a*.

In the embodiment of the present disclosure, the optical sensing module 710 may transmit the adjustment value generated by the optical sensing module to the display control module 720, and then the display control module 720 adjusts the overall brightness of the display panel 100 according to the adjustment value, specifically embodied as the adjustment of the brightness of each pixel unit 110. It should be noted that as shown in FIG. 16, each composite pixel unit 110*a* in the first row is connected with the optical sensing module 710, and the display control module 720 is connected with the display panel 100. In actual application, the display control module 720 is connected with each data line in the display panel 100 and transmits the display signal to each column of pixel units 110 of the display panel 100 through the data line.

Figure 17:
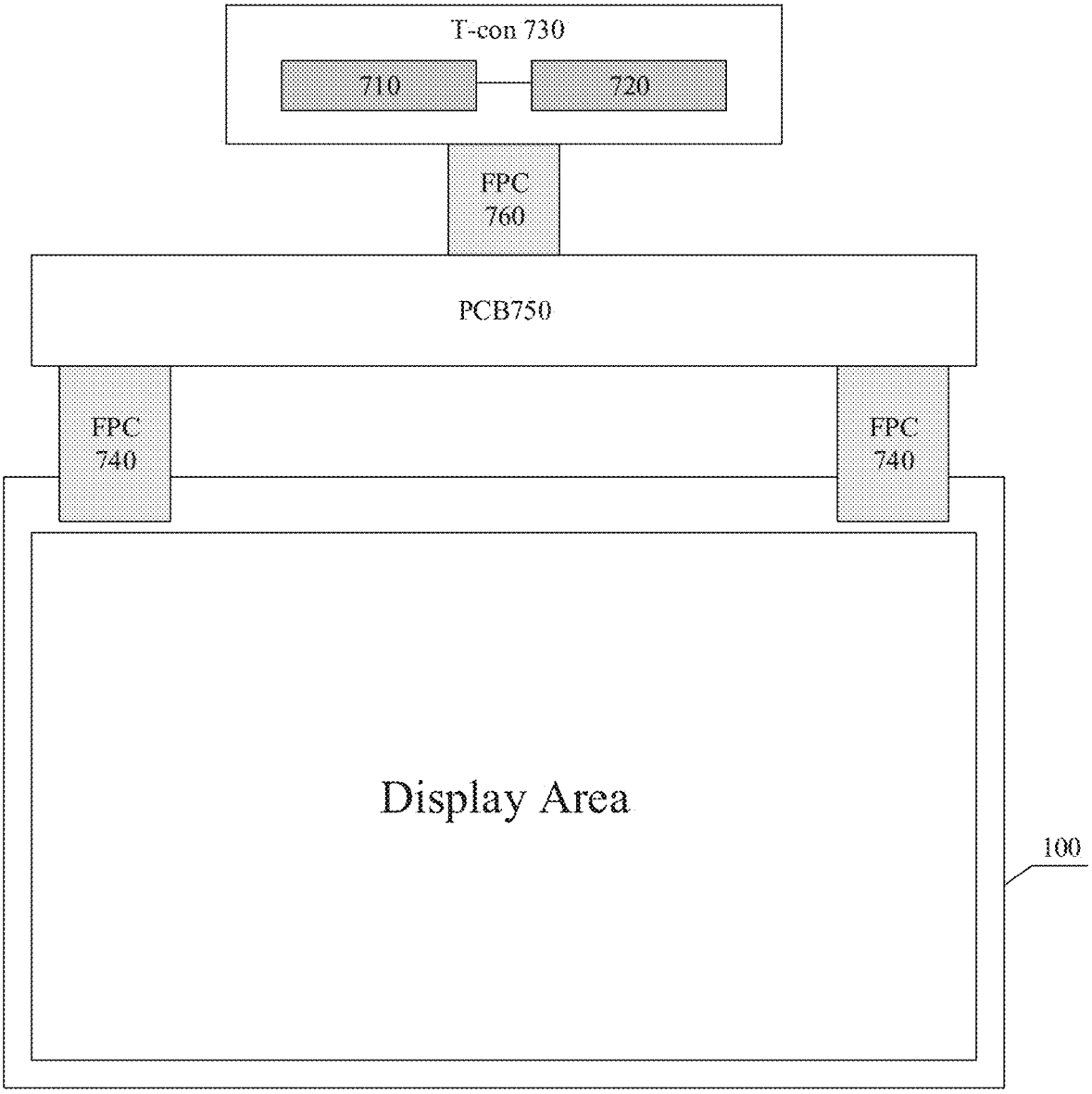
FIG. 17 is a schematic structural view of still another display device provided by an embodiment of the present disclosure.

Optionally, FIG. 17 is a schematic structural view of still another display device provided by the embodiment of the present disclosure. On the structural basis of the display device as shown in FIG. 16, the display device provided by the embodiment of the present disclosure may further comprise:

a timing controller (T-con) 730 configured to control the pixel unit 110 to execute the display operation and control the composite pixel unit 110*a* to execute the display operation or the signal acquisition operation.

In the embodiment of the present disclosure, the T-con 730 controls the pixel unit 110 to execute the display operation and controls the composite pixel unit 110*a* to execute the signal acquisition operation. The pixel unit 110 for executing the display operation also includes the composite pixel unit 110*a*. Moreover, the means of the T-con 730 in realizing the above operation by control may refer to the embodiment of the method for driving the display panel provided by the present disclosure, namely the driving method provided by the embodiment as shown in FIGS. 7 to 10, so no further description will be given here.

It should be noted that both the optical sensing module 710 and the display control module 720 in the embodiment of the present disclosure may be disposed in the T-con 730. In one implementation of the embodiment of the present disclosure, the optical sensing module 710 and the display control module 720 are respectively integrated into different integrated circuit (IC) chips of the T-con 730. The specific structure of the display panel 100 is not shown in FIG. 17. The display panel 100 provided by any foregoing embodiment of the present disclosure may be selected. FIG. 17 also shows the actual connection mode of the optical sensing module 710, the display control module 720 and the T-con 730 and the display panel. The display panel 100 in FIG. 17 is connected to a printed circuit board (PCB) 750 through a flexible printed circuit (FPC) 740, and the PCB 750 is connected with the T-con 730 through an FPC 760.

Figure 18:
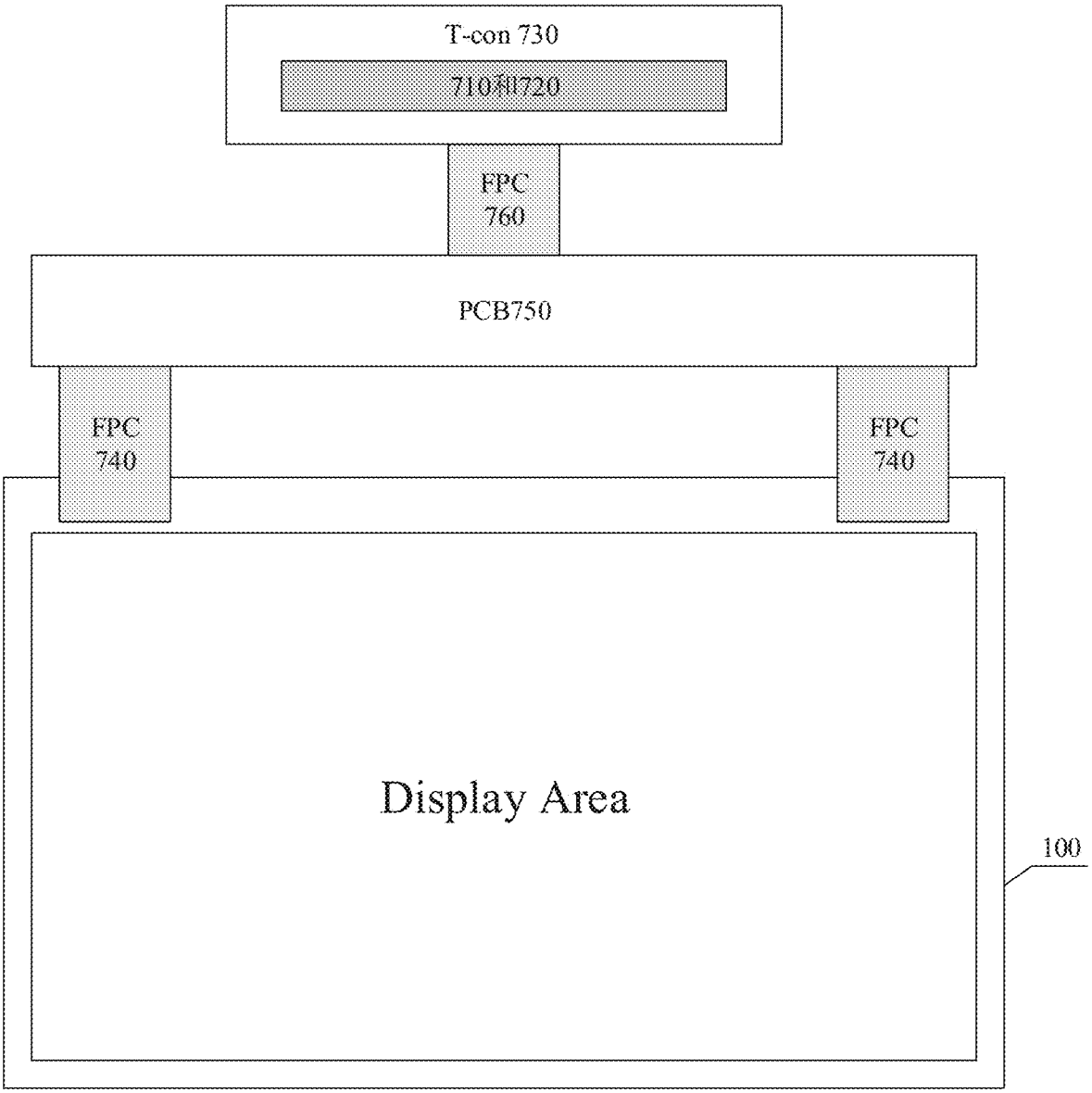
FIG. 18 is a schematic structural view of still another display device provided by an embodiment of the present disclosure.

In another implementation of the embodiment of the present disclosure, the optical sensing module 710 and the display control module 720 are integrated into the same IC chip in the T-con 730. FIG. 18 is a schematic structural view of still another display device provided by the embodiment of the present disclosure. Compared with the structures of the display device in FIGS. 17 and 18, as for two chips in the T-con 730 shown in FIG. 17, one is used for realizing the functions of the optical sensing module 710 and the other is used for realizing the functions of the display control module 720. FIG. 18 shows one chip in the T-con 730, and the chip integrates the functions of the optical sensing module 710 and the display control module 720.

Figure 19:
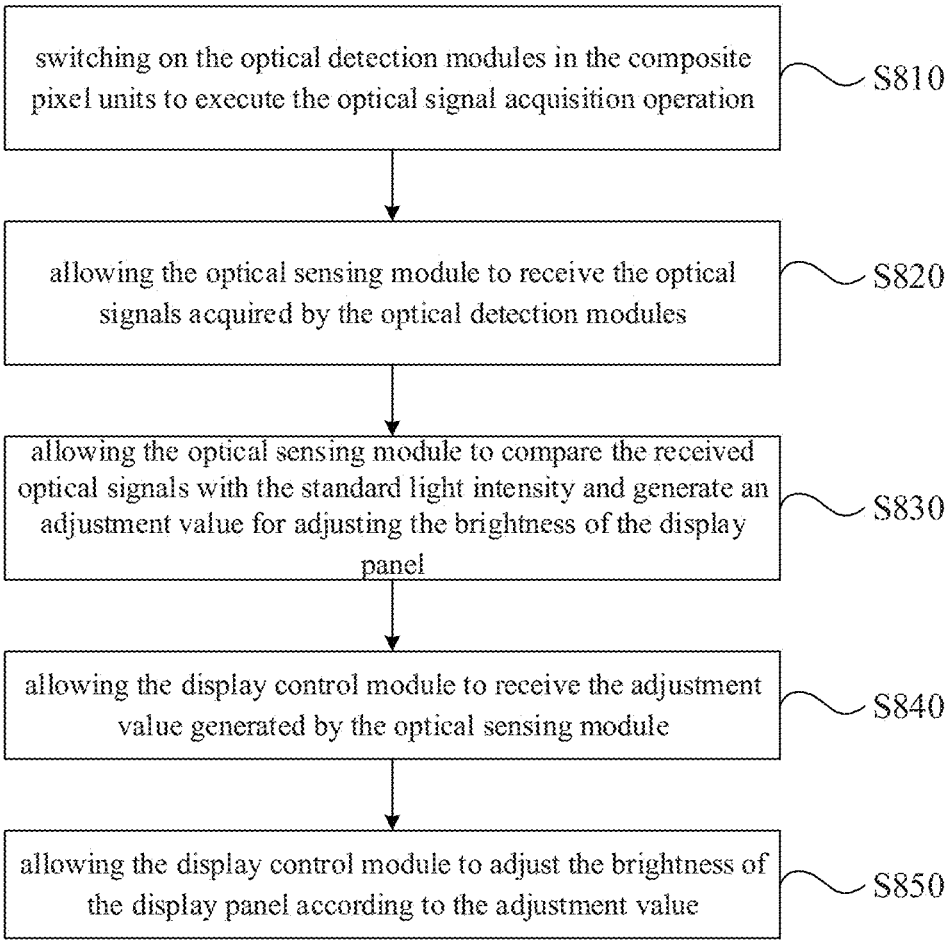
FIG. 19 is a flowchart illustrating a process of executing brightness adjustment by adoption of the display device provided by an embodiment of the present disclosure.

FIG. 19 is a flowchart of adopting the display device provided by the embodiment of the present disclosure to execute brightness adjustment. The process of brightness adjustment may include the following steps:

S810: switching on the optical detection modules in the composite pixel units to execute the optical signal acquisition operation and acquire optical signals in the current ambient light, in which the mode of executing acquisition operation has been described in detail in the above embodiment, so no further description will be given here;

S820: allowing the optical sensing module to receive the optical signals acquired by the optical detection modules;

S830: allowing the optical sensing module to compare the received optical signals with the standard light intensity and generate an adjustment value for adjusting the brightness of the display panel;

S840: allowing the display control module to receive the adjustment value generated by the optical sensing module; and S850: allowing the display control module to adjust the brightness of the display panel according to the adjustment value.

In the embodiment of the present disclosure, the optical detection module feeds back the acquired optical signal to the optical sensing module and generates the adjustment value adapted to the current ambient light intensity; the optical sensing module feeds back corresponding display brightness and input current to the display control module; and the display control module controls the display operation of the display panel, so as to ensure that the parameters of the display panel such as brightness and color temperature change along with the change of the ambient light.

In the embodiments of the disclosure, the modules may be achieved by software so as to be executed by various types of processors. For example, a marked executable code module may include one or more physical or logical blocks of a computer instruction, and for instance, may be constructed as an object, a procedure or a function. Even so, executable codes of the marked module are not required to be physically located together but may include different instructions stored on different physical blocks. When the instructions are logically combined, a module is constructed and the predetermined object of the module is achieved.

Actually, the executable code module may include a single instruction or many instructions which may even be distributed on a plurality of different code segments, distributed in different programs, and distributed on a plurality of storage devices. Similarly, operational data may be identified in the module, achieved by any appropriate means and organized in any appropriate type of data structure. The operational data may be collected as a single data set or may be distributed at different positions (including the case of being distributed on different storage devices) and may at least partially exist on a system or a network by being only taken as electronic signals.

When the module can be achieved by software, in view of the level of the traditional hardware technology, those skilled in the art can establish corresponding hardware circuits on modules capable of being achieved by software to achieve corresponding functions regardless of the cost. The hardware circuits include conventional very large scale integration (VLSI) circuits or gate arrays and conventional semiconductors such as logic chips and transistors or other discrete elements. The module may also be achieved by programmable hardware units such as field programmable gate arrays, programmable logic arrays and programmable logical devices.

The embodiment of the present disclosure further provides a computer readable storage medium, wherein executable instructions are stored in the computer readable storage medium, and upon the executable instructions being executed by a processor, the method for driving the display panel provided by any foregoing embodiment of the present disclosure can be realized. The method for driving the display panel may be used for driving the display panel provided by the embodiment of the present disclosure for display, and simultaneously execute the optical signal acquisition operation. The embodiment of the computer readable storage medium provided by the embodiment of the present disclosure is basically the same with that of the method for driving the display panel provided by the above embodiment of the present disclosure, so no further description will be given here.

The foregoing is merely exemplary embodiments of the invention, but is not used to limit the protection scope of the invention. The protection scope of the invention shall be defined by the attached claims.

The invention claimed is:

1. A display panel, comprising: pixel units arranged in an array, wherein each pixel unit includes a display pixel part, and at least a part of the pixel units are configured to be composite pixel units; each of the composite pixel units further includes an optical detection part; the optical detection part is configured to execute optical signal acquisition operation; and the display pixel part is configured to execute display operation, wherein the display pixel part includes a pixel electrode and a pixel transistor; and the optical detection part includes a phototransistor, wherein a channel length of the phototransistor is greater than a channel length of the pixel transistor.

2. The display panel according to claim 1, further comprising: a control circuit which is respectively connected with the optical detection part and the display pixel part and configured to adjust a display brightness of the display pixel part according to an optical signal detected by the optical detection part.

3. The display panel according to claim 1, wherein the pixel transistor and the phototransistor are arranged on a same layer.

4. The display panel according to claim 1, wherein a gate electrode, an active layer and source/drain electrodes of the pixel transistor are respectively arranged in same layers with a gate electrode, an active layer and source/drain electrodes of the phototransistor.

5. The display panel according to claim 1, further comprising: data lines, gate lines and common electrode lines, wherein the optical detection parts in the composite pixel units and the display pixel parts in the display panel share the data lines, the gate lines and the common electrode lines.

6. The display panel according to claim 5, wherein in each of the composite pixel units, a gate electrode of the pixel transistor and a gate electrode of the phototransistor are connected to a same gate line; a drain electrode of the phototransistor is connected to a corresponding common electrode line; a source electrode of the pixel transistor and a source electrode of the phototransistor are connected to a same data line or different data lines; one of the pixel transistor and the phototransistor is an N-type transistor; and the other one of the pixel transistor and the phototransistor is a P-type transistor.

7. The display panel according to claim 6, wherein in the composite pixel unit disposed in the $i^{th}$ row and the $j^{th}$ column of the display panel, the gate electrode of the pixel transistor and the gate electrode of the phototransistor are connected to the gate line in the $i^{th}$ row; the drain electrode of the phototransistor is coupled to the corresponding common electrode line; the source electrode of the pixel transistor is connected to the data line in the $j^{th}$ column; and the source electrode of the phototransistor is connected to the data line in the $j^{th}$ column or the $(j+1)^{th}$ column, in which both i and j are a positive integer greater than or equal to 1.

8. The display panel according to claim 7, wherein the display panel comprises n rows and m columns of pixel units, in which n is a positive integer greater than or equal to i, and m is a positive integer greater than or equal to j; and positions of the composite pixel units include:

in the $i^{th}$ row of pixel units of the display panel, at least a part of pixel units are configured to be the composite pixel units; or in the $j^{th}$ column of pixel units of the display panel, at least a part of pixel units are configured to be the composite pixel units;

in the pixel units at a periphery of the display panel, at least a part of pixel units are configured to be the composite pixel units; or the pixel units in the $x^{th}$ row and the $y^{th}$ column of the display panel are configured to be the composite pixel units, in which x is selected from a plurality of positive integers from 1 to n, and y is selected from a plurality of positive integers from 1 to m.

9. The display panel according to claim 6, wherein each of the composite pixel units is configured to execute the optical signal acquisition operation according to a signal acquisition instruction sent by the data line connected with the optical detection part, and output an optical signal acquired through the common electrode line.

10. The display panel according to claim 1, further comprising: data lines, gate lines, common electrode lines and at least one optical acquisition control line, wherein in each of the composite pixel units, a gate electrode of the pixel transistor is connected to a corresponding gate line; a gate electrode of the phototransistor is connected to a corresponding optical acquisition control line; a drain electrode of the phototransistor is connected to a corresponding common electrode line; and a source electrode of the pixel transistor and a source electrode of the phototransistor are connected to a same data line or different data lines.

11. The display panel according to claim 1, wherein the phototransistor is of top-gate type, and further comprises a light conversion layer located at a side of a gate electrode of the phototransistor away from an active layer of the phototransistor.

12. The display panel according to claim 1, further comprising data lines and common electrode lines, and a source electrode and a drain electrode of the phototransistor are connected to a corresponding data line and a corresponding common electrode line.

13. A method for driving a display panel, applied to the display panel according to claim 1, comprising:

switching on the display pixel parts in the pixel units to execute the display operation in a first period; and switching on the optical detection parts in the composite pixel units to execute the optical signal acquisition operation in a second period, wherein the display panel includes gate lines and at least one optical acquisition control line; the optical detection parts of the composite pixel units are connected with the at least one optical acquisition control lines; the display pixel parts of the pixel units are connected with the gate lines; and the method comprises: loading a first scanning signal through the gate lines in the first period to switch on the display pixel parts, and loading a second scanning signal through the at least one optical acquisition control line in the second period to switch on the optical detection parts.

14. The method for driving the display panel according to claim 13, wherein the display panel includes n rows of pixel units, in which at least a part of pixel units in the $i^{th}$ row of pixel units are configured to be the composite pixel units; i is a positive integer greater than or equal to 1; n is a positive integer greater than or equal to i; and switching on the display pixel parts in the pixel units to execute the display operation and switching on the optical detection parts in the composite pixel units to execute the optical signal acquisition operation includes:

sequentially loading a first scanning signal, in the first period of each frame of time through the gate lines from the gate line of the $1^{st}$ row of pixel units to the gate line of the $n^{th}$ row of pixel units, to sequentially switch on each row of display pixel parts to execute the display operation, and loading a second scanning signal, in the second period of each frame of time through the gate line of the $i^{th}$ row of pixel units, to switch on the optical detection parts of the composite pixel units in the $i^{th}$ row of pixel units to execute the optical signal acquisition operation.

15. A method for driving a display panel, applied to the display panel according to claim 1, comprising:

switching on the display pixel parts in the pixel units to execute the display operation in a first period; and switching on the optical detection parts in the composite pixel units to execute the optical signal acquisition operation in a second period, wherein the display panel includes n rows of pixel units, in which in each row of pixel units in at least two rows of pixel units, at least a part of pixel units are configured to be the composite pixel units; n is a positive integer greater than or equal to 2; and switching on the display pixel parts in the pixel units to execute the display operation and switching on the optical detection parts in the composite pixel units to execute the optical signal acquisition operation includes:

sequentially loading a first scanning signal, in the first period of each frame of time through the gate lines from the gate line of the $1^{st}$ row of pixel units to the gate line of the $n^{th}$ row of pixel units, to sequentially switch on each row of display pixel parts to execute the display operation; sequentially loading a second scanning signal, in the second period of each frame of time through the gate lines from the gate line of the $x^{th}$ row of pixel units to the gate line of the $y^{th}$ row of pixel units, to switch on the optical detection parts of the composite pixel units in each row of pixel units from the $x^{th}$ row of pixel units to the $y^{th}$ row of pixel units to execute the optical signal acquisition operation, in which the $x^{th}$ row of pixel units to the $y^{th}$ row of pixel units are the at least two rows of pixel units provided with the composite pixel units; x is a positive integer greater than or equal to 1 and less than or equal to y; y is a positive integer greater than x and less than or equal to n; numbers from x to y are serial numbers or non-continuous numbers; or in the scanning time of scanning the $z^{th}$ row of pixel units of each frame of time, loading a first scanning signal, in the first period through the gate line of the $z^{th}$ row of pixel units, to switch on the $z^{th}$ row of display pixel parts to execute the display operation, and loading a second scanning signal, in the second period through the gate line of the $z^{th}$ row of pixel units, to switch on the optical detection parts of the composite pixel units in the $z^{th}$ row of pixel units to execute the optical signal acquisition operation, in which the $z^{th}$ row of pixel units is one of the at least two rows of pixel units provided with the composite pixel units; and z is a positive integer greater than or equal to 1 and less than or equal to n.

16. A display device, comprising: the display panel according to claim 1 and an optical sensing module connected with the optical detection part in each of the composite pixel units of the display panel, wherein the optical sensing module is configured to receive an optical signal acquired by the optical detection part and generate an adjustment value for adjusting a brightness of the pixel unit in the display panel according to the optical signal.

17. The display device according to claim 16, further comprising:

a display control module connected with the optical sensing module and configured to receive the adjustment value generated by the optical sensing module and adjust the brightness of the pixel unit in the display panel according to the adjustment value.

* * * * *